United States Patent [19]

Madray

[11] Patent Number: 4,688,358

[45] **Date of Patent: * Aug. 25, 1987**

[54] CONSTRUCTION SYSTEM

[76] Inventor: Herbert R. Madray, P.O. Box 712, Okeechobee, Fla. 33472

[ * ] Notice: The portion of the term of this patent subsequent to Nov. 12, 2002 has been disclaimed.

[21] Appl. No.: 797,028

[22] Filed: Nov. 12, 1985

Related U.S. Application Data

[63] Continuation-in-part of Ser. No. 709,317, Jan. 22, 1985, which is a continuation-in-part of Ser. No. 496,960, May 23, 1983, Pat. No. 4,551,957.

[51] Int. Cl.[4] ..... E04B 7/02

[52] U.S. Cl. ..... 52/90; 52/665; 52/721; 403/171

[58] Field of Search ..... 52/90–94, 52/665, 721; 403/205, 170, 171, 174, 178, 295, 403; 446/476

[56] References Cited

U.S. PATENT DOCUMENTS

| | | | |
|---|---|---|---|
| 1,763,300 | 6/1930 | Gilbert | 446/476 |
| 1,850,118 | 3/1932 | Meyers . | |
| 1,959,880 | 5/1934 | Sims . | |
| 2,067,403 | 1/1937 | Lea . | |
| 2,082,138 | 6/1937 | Badel | 446/476 |
| 2,574,074 | 11/1951 | Vogel | 52/721 |
| 3,304,683 | 2/1967 | Ferreira | 52/721 X |
| 3,471,981 | 10/1969 | Segil et al. | 52/220 |
| 3,653,172 | 4/1972 | Schwartz | 52/721 X |
| 3,787,130 | 1/1974 | Hemmings et al. | 403/205 |
| 3,890,755 | 6/1975 | Specht | 52/721 X |
| 4,011,697 | 3/1977 | Fedolfi | 52/90 |
| 4,054,012 | 10/1977 | Paradisi et al. | 52/544 |
| 4,076,432 | 2/1978 | Glaser | 403/171 X |
| 4,078,847 | 3/1978 | Presnick | 403/171 X |
| 4,142,335 | 3/1979 | Andrade | 52/90 |
| 4,205,497 | 6/1980 | Schirm | 52/90 |
| 4,275,534 | 6/1981 | Porter | 52/721 X |
| 4,305,677 | 12/1981 | Kowalski | 403/205 |
| 4,347,015 | 8/1982 | Olashaw | 403/171 X |
| 4,350,318 | 9/1982 | Gallis | 249/40 |
| 4,356,675 | 11/1982 | Reicherts | 52/90 X |
| 4,365,453 | 12/1982 | Lowe | 52/90 X |
| 4,551,957 | 11/1985 | Madray | 52/90 |

FOREIGN PATENT DOCUMENTS

| | | | |
|---|---|---|---|
| 847068 | 8/1952 | Fed. Rep. of Germany . | |
| 2430235 | 1/1975 | Fed. Rep. of Germany | 403/171 |
| 2902322 | 7/1980 | Fed. Rep. of Germany . | |
| 3033114 | 3/1982 | Fed. Rep. of Germany . | |
| 743675 | 4/1933 | France . | |
| 53974 | 8/1946 | France | 403/170 |
| 1229153 | 9/1960 | France . | |
| 1295797 | 5/1962 | France | 403/171 |
| 2340433 | 2/1977 | France . | |
| 783403 | 9/1957 | United Kingdom . | |
| 967965 | 8/1964 | United Kingdom | 403/171 |
| 1006324 | 9/1965 | United Kingdom | 52/93 |
| 1025751 | 4/1966 | United Kingdom | 52/93 |

*Primary Examiner*—J. Karl Bell

*Attorney, Agent, or Firm*—Steele, Gould & Fried

[57] ABSTRACT

A method and apparatus are provided for constructing buildings and the like, and particularly for constructing multistory structures. Adapters are disclosed which can be rapidly attached to girder members by attachment structure. The adapters are preferably prefabricated with flanges to form at least two receiving channels of uniform width and cross-section. Channel members preferably of C-shaped cross-section define studs and other building components which are interconnected by means of the adapters. The adapters and channel members are attachable to one another at repetitive patterns of connection holes.

10 Claims, 68 Drawing Figures

FIG. 3
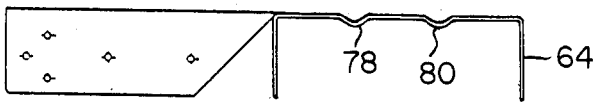
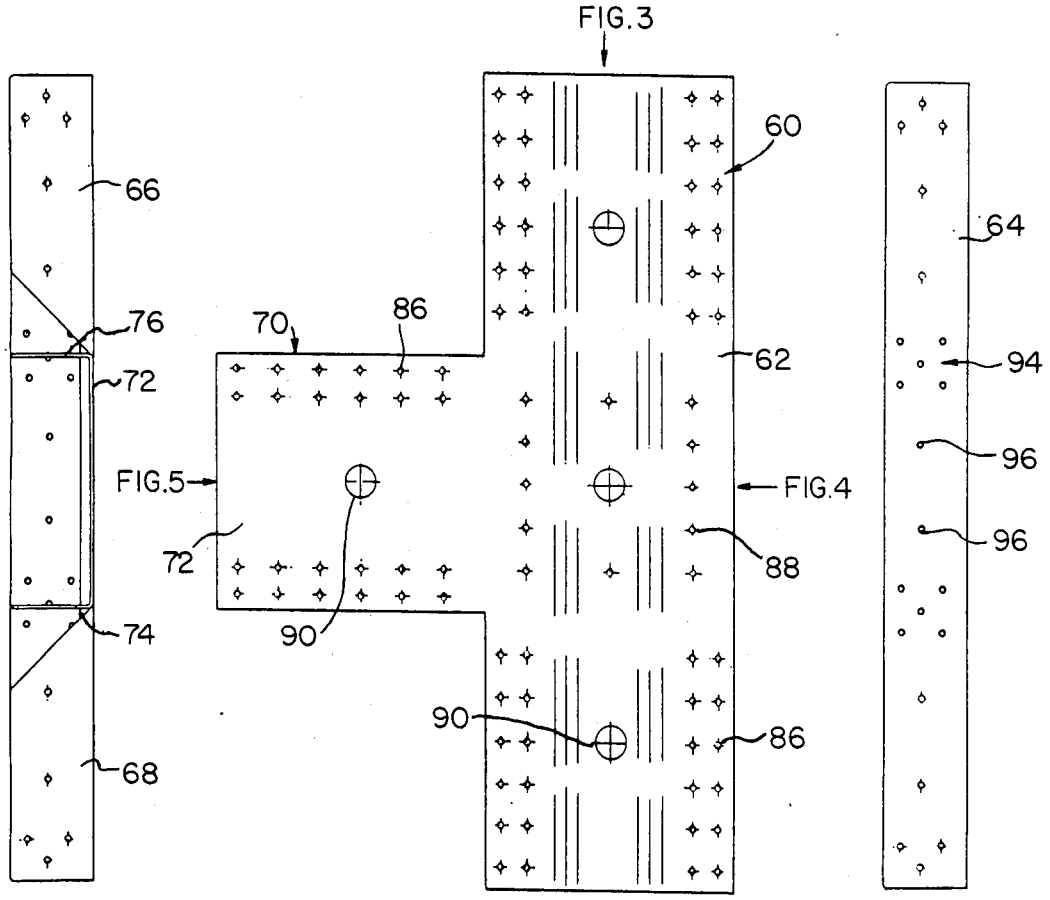
FIG. 5 FIG. 2 FIG. 4

FIG. 38
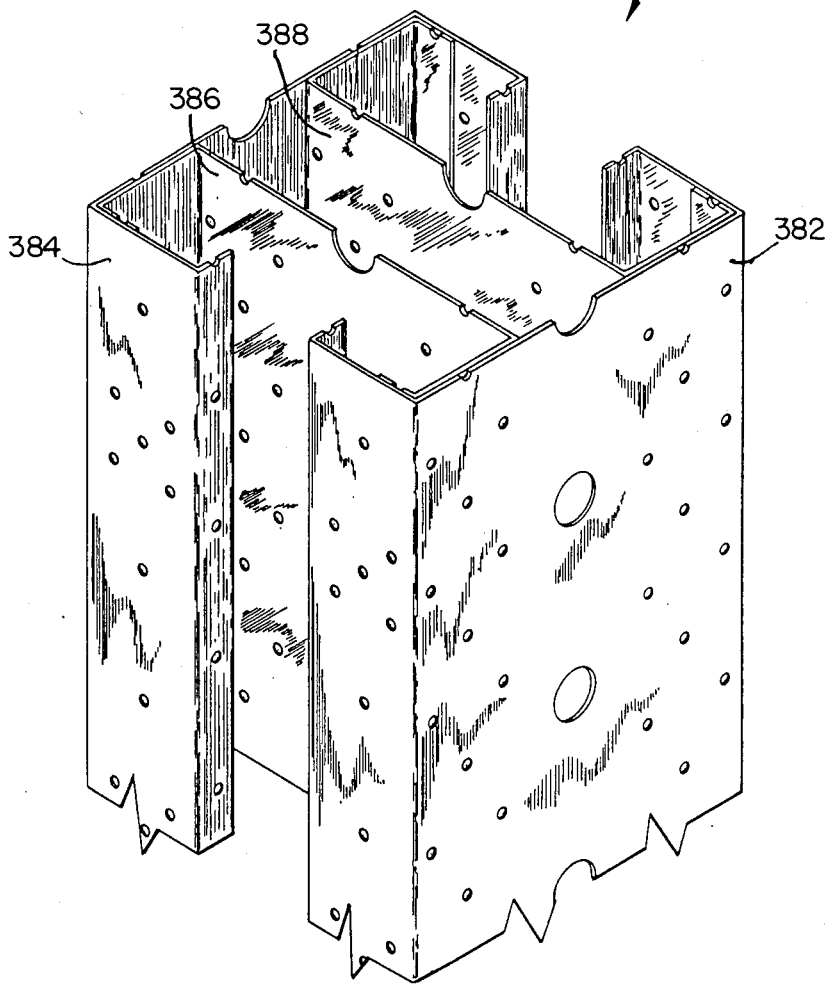
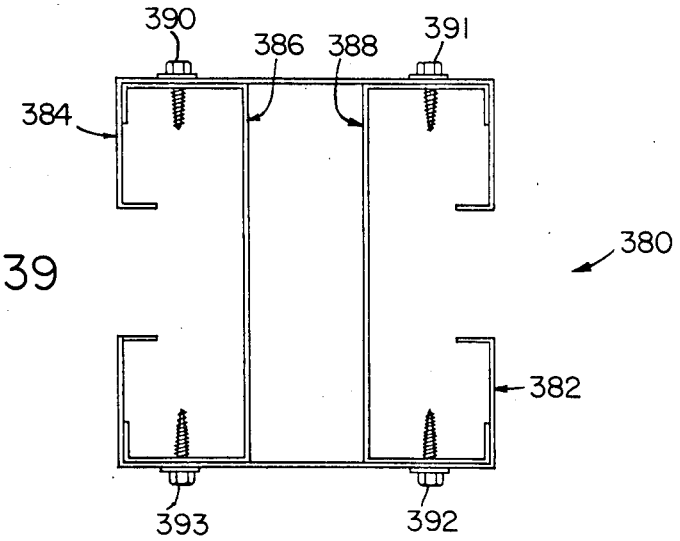
FIG. 39

FIG.46
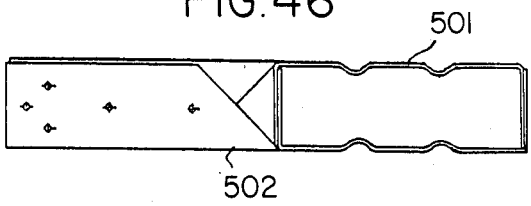
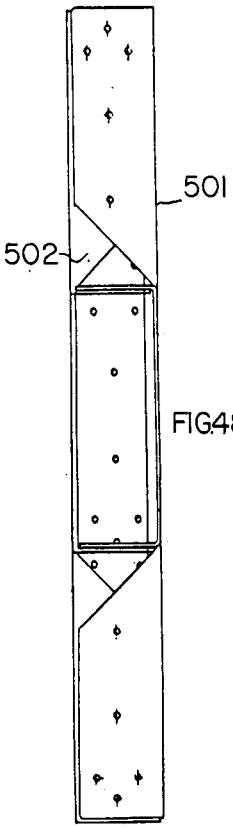
FIG.48
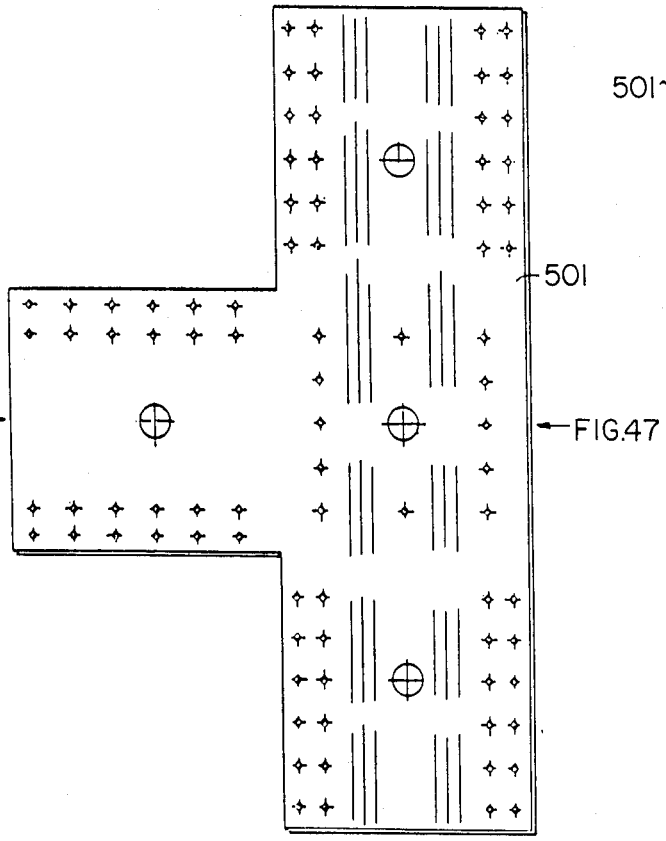
FIG.45
FIG.46
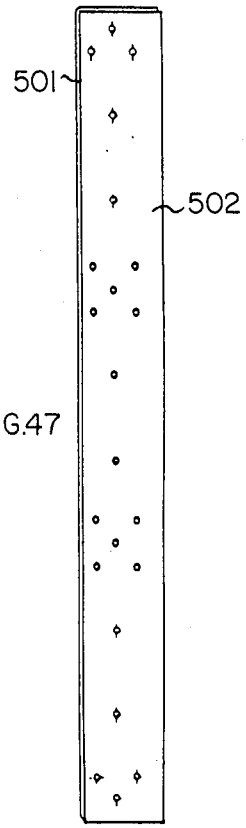
FIG.47

CONSTRUCTION SYSTEM

CROSS REFERENCE TO RELATED APPLICATIONS

This application is a continuation-in-part of co-pending U.S. patent application Ser. No. 709,317, filed Jan. 22, 1985, which is the U.S. national phase application of PCT Application Ser. No. PCT/US 84/00782, filed May 22, 1984. Application Ser. No. 709,317 is a continuation-in-part of co-pending U.S. patent application Ser. No. 496,960, filed May 23, 1983, now U.S. Pat. No. 4,551,957.

BACKGROUND OF THE INVENTION

1. Field of the Invention

This invention relates generally to building constructions, and more particularly to multistory building constructions.

2. Description of the Prior Art

A number of construction systems have been conceived which purport to be based upon a limited number of standardized elements. Similarly, metallic building constructions have been attempted using durable metal frame pieces, for example, extruded beams, studs and joists. The prior art systems include many conveniences in manufacture or interconnection applicable to a limited range of structural designs. The known systems, however, have been impractical for building larger multistory structures and the like, which typically place much greater stress on the components. Standardization for multistory structures is usually also economically impractical, as these structures are rarely reproduced more than a few times, if at all. The cost effectiveness of standardization is of course minimized when few structures are being produced according to the design. Multistory structures also necessarily require the interconnection of a great number of components. Numerous components magnify design tolerances such that it can be difficult to interconnect the sometimes thousands of the pieces.

The present invention departs from the prior art use of unstandardized or fully prefabricated modular elements, and instead relies upon novel constructions of improved framing elements and surface forming elements which are universally interconnectable: The parts are all dimensioned such that they are connectable at any of a plurality of incremental relative positions by means of repeating patterns of connection holes. Standard attachment means are secured in aligned connection holes. The structure of the invention is therefore prefabricated in the sense that all the parts are standardized and interfittable. At the same time, the invention is universal because, although the parts are prefabricated, they can be practically connected in innumerable ways along the complimentary dimensioned interconnections to form innumerable different structures.

A basic component for building constructions according to the invention is a channel member preferably having a squared-off C-shaped cross-section, which functions as studs, joists and headers. Adaptors for connecting the channel members fit snugly within (or around) the C-shaped cross-section and engage the full inner (outer) surface of the channel member, whereby the structure bears loads far in excess of what may be expected from connections relying only on bolts or similar construction elements. In fact, the elements share structural loads and are therefore much stronger than known prefabricated systems, conventional metallic stud systems, and the like. It is possible to variously interconnect the channel members to provide structural elements of even greater strength.

Both the siding and roofing are comprised of strip elements which may be serially connected along interfitting edges. Each strip has a first edge defining a protrusion, a second edge defining a receptacle, and an attachment flange which is fixed to the frame elements and then covered in turn by a successive strip. An engagement structure, including the same form of protrusion, is provided on starting elements for the siding and for the roofing, for example, at the lower edge of the siding and at the lower edge of the roof eaves. The required structures are thus repeated from the starting elements to the upper edge of such siding and/or roofing strip.

According to the invention, the builder is provided with a series of matched interfittable elements which can be obtained as desired to correspond in part to traditional multistory building elements such as studding, siding, and roofing. The builder can therefore produce virtually any required structure. The elements, however, are stronger and more conveniently used than either traditional or formerly known prefabricated structures due to the standardized dimensions and spacing of elements that allow the wide range of structures to be accomplished, with virtually no custom fitting of parts, no cutting and no need to provide aligned holes for attachments. The result is a durable and attractive structure benefitting from the best features of prefabrication and the best of custom design. An external appearance characteristic of the most artful traditional building is provided, together with the great durability and strength of a beamed metal structure. Not only the roofing, siding and external portions, but the internal wall and trim portions as well benefit from the plan of interfitting parts and interfitting, which truly facilitate a standardized constructions.

Multistory buildings are constructed according to the invention in much less time than is required by conventional building techniques. The universal interconnections made possible by the invention facilitate a maximum variability in design capability. Components according to the invention can be rapidly produced to provide a complete set of materials necessary for constructing the framework of the building. Positions under greater stress than others can be accommodated by the simple construction of compound elements interconnected according to the invention. Assembly requires merely the interconnection of the various components with suitable fastening structure. In this manner, the necessity of skilled labor is kept to a minimum and production time and costs are also minimized.

SUMMARY OF THE INVENTION

It is an object of the invention to provide a building system which produces a wide variety of structurally strong and durable multistory buildings using matched parts, standardized for easy and inexpensive assembly.

It is also an object of the invention to standardize conventional constructions based upon adapting building construction elements of a general type traditional to multistory buildings, using very durable metallic constructions elements which are universally interconnectable at any required alignment spacing.

It is another object of the invention to provide a building system in which more durable elements than conventional building elements are made easily and precisely interconnectable at required alignments, by use of a minimum number of additional elements which fully engage abutting parts at specific interconnection points, permitting very strong, high-speed, and very precise construction at any of an immense plurality of predetermined incremental sizes and shapes of buildings.

It is yet another object of the invention to provide a system for producing structures of maximum durability and maximum variety, at minimum expense in parts and in labor for the interconnection of parts.

These and other objects are accomplished by a metallic multistory construction system including a plurality of interfitting components for general purpose building requirements. Channel members of C-shaped cross-section define girder members such as studs, headers and joists which are interconnected by means of adapters. Adaptors for connecting the channel members fit snugly within the C-shaped cross-section and engage the full inner surface of the channel member. The adapters are preferably prefabricated with flanges to form at least two receiving channels of uniform width and cross-section. The adapters and channel members are attached to one another at repetitive patterns of connection holes. The repetitive patterns of holes are also provided for engagement for siding, roofing, and additional building structure, each of which has correctly dimensioned structure for engaging the repeating patterns of holes and also possibly for engaging in successive strip of such siding and roofing. Structural braces may also be provided, as well as trim and other parts, whereby a general purpose system applicable to a wide range of dimensions and designs is possible.

A "T" adapter is provided for three-way connection such as the connections between floor joists and exterior wall studs. The "T" adapter includes a long channel. The "T" adapter preferably includes a substantially planar "T" shaped web portion of uniform web width. Flanges at the sides of the web portions form channel members adapted to receive the channel members.

A cross adapter is provided for four-way connections such as the connections of floor joists to interior wall studs. The cross adapter has web portions which cross at substantiall right angles and which preferably bisect one another. Each channel has upturned flange portions to define channels which snugly interfit the girder members for secure connections.

Two adapters of channel-shaped cross-section may be joined at their upturned flange portions as by welding or the like to form adapters of substantially box-shaped cross-section. These adapters provide additional strength and rotational rigidity when necessary. The adapters in channel members are touchable to one another at repetitive patterns of connection holes.

BRIEF DESCRIPTION OF THE DRAWINGS

There are shown in the drawings the embodiments which are presently preferred it being understood, however, that the invention is not limited to the precise arrangements and instrumentalities shown in the drawings, wherein:

FIG. 2 is a front elevation of a T adapter according to the invention.

FIG. 3 is a top plan of a T adapter according to arrow 3 in FIG. 2.

FIG. 4 is a side view of a T adapter according to arrow 4 in FIG. 2.

FIG. 5 is a side view of a T adapter according to arrow 5 in FIG. 2.

FIG. 38 is a perspective of an alternative compound component.

FIG. 39 is an end view of the alternative compound component of FIG. 37.

FIG. 45 is a front elevation of the closed channel T adapter according to the invention.

FIG. 46 is a top plan view according to arrow 46 in FIG. 45.

FIG. 47 is a right side elevation according to arrow 47 in FIG. 45.

FIG. 48 is a left side elevation according to arrow 48 in FIG. 45.

DESCRIPTION OF THE PREFERRED EMBODIMENTS

Figure 1:
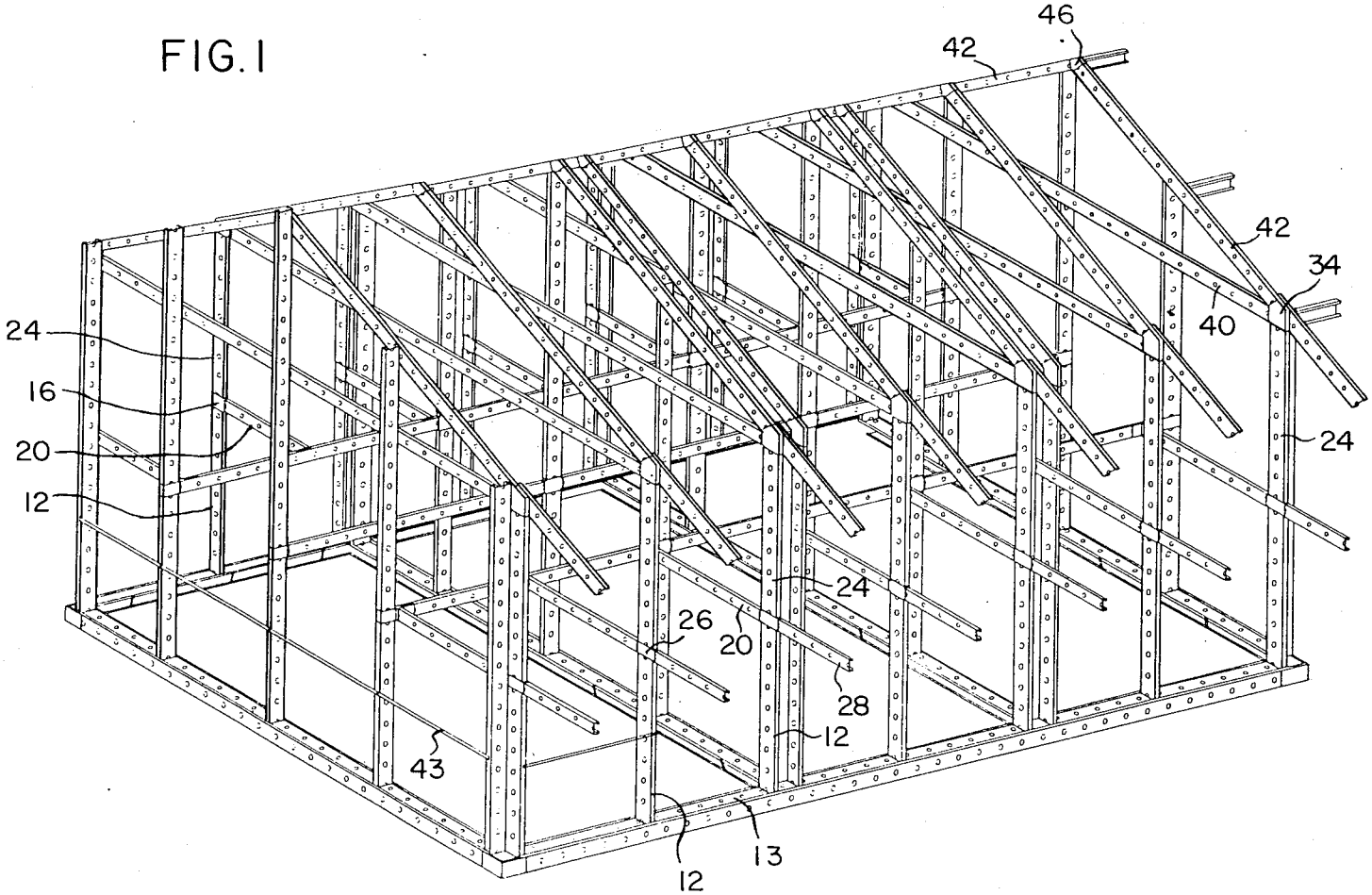
FIG. 1 is a perspective view of a finished frame structure according to the invention.

FIG. 1 depicts a multistory building construction possible with the construction system of the invention. The construction shown in FIG. 1 is seen to be a two story structure with a conventional ridge roof. While the present description will refer to a two story embodiment, it would be apparent to one skilled in the art that the concepts disclosed herein are applicable to structures of any number of stories and of varying designs. A number of first story wall studs 12 frame the vertical walls of the structure and can be anchored to a footing or footing frame as by track 13. A number of T adapters 16 provide three-way connection between the first story wall studs 12 and floor joists 20. The T adapters 16 additionally join a plurality of second story vertical stud members 24. A plurality of cross adapters 26 provide four-way connection as, for example, between floor joist 20, balcony floor joist 28, first story vertical stud 12 and second story vertical stud 24. A plurality of truss adapters 34 connect the second story wall studs 24 to truss members including headers 40 and roof joists 42. A plurality of roof ridge adapters 46 angularly connect top roof joists 42 to form a traditionally angled slanted roof. Additional framing features such as V-braces 43 and the like, may be added. The floors may be laid over the floor joists by methods known in the art including wood decking or a thin floor slab of concrete poured over steel lathe, corrugated steel sheet, or cellular steel decking. The above-described embodiment is by way of illustration only, as the inventive concepts disclosed herein could be applied to virtually any building design which can be oherwise constructed by conventional building techniques.

The method of the invention is well suited for modular building constructions, especially those set forth in co-pending applications. The teachings of co-pending applications Ser. No. 496,960, filed May 23, 1983; Ser. No. PCT/US 84/00782, filed May 22, 1984; Ser. No. 678,505, filed Dec. 5, 1984; Ser. No. 678,507, filed Dec. 5, 1984; Ser. No. 678,508, filed Dec. 5, 1984; Ser. No. 709,317, filed Jan. 22, 1985; Ser. No. 723,282, filed Apr. 15, 1985; and Ser. No. 723,349, filed Apr. 15, 1985 are hereby incorporated fully by reference. The co-pending applications disclose methods and apparatus for constructing a building structure using a series of pre-engineered components which can be interconnected on site in innumerable ways to form an integral building structure without the need for complete prefabrication for any particular design.

The construction system of the invention provides for the connection of multistory framing components such as studs, headers, and joists by interfitting the framing components with the adapter elements whereby the abutting connections of the various framing components are unusually strong. The load bearing capabilities of the resulting structures are effectively multiplied. This is accomplished because the interconnection along the entire inner area of each framing component with the adapters permits the load to be shared between the connected framing components rather than borne only by bolts or the like.

Adaptor elements according to the invention are preferably plate members prefabricated to form receiving structure of uniform web width and cross-section. The plate members are preferably prefabricated with flanges to form receiving channels. The receiving channels can be formed in a plurality of relative angles. More than two angularly related receiving channels of uniform web width and cross-section are possible in a single adapter element to enable multi-component connection in a plurality of relative angles. It is preferable that the respective web widths of each end of each girder member and each receiving channel are dimensioned to enable portions of each to nest snugly one inside the other. Primary loads are thereby borne by and transmitted between the girder and plate membersin planes defined by the nested webs. The flanges of the nested ends bear against one another to provide high rotational rigidity and overall frame stiffness.

An adapter according to the invention is depicted in FIGS. 2–6. The T adapter is provided for three-way connections such as the connections between floor joists and exterior wall studs. The adapter includes a long channel 60 preferably of U-shape cross-section and formed by web portion 62, long flange 64, and short flanges 66 and 68. The long channel 60 may engage a girder member at both ends. A short channel 70 extends perpendicularly in one direction from and substantially bisecting the long channel 60 to form a T shaped channel adapter. The short channel 70 is preferably of U-shaped cross-section and formed by a web portion 72 and flanges 74, 76. The channel 70 may engage a girder member to complete a three-way, "T" shaped connection. Structure such as ribs 78, 80 can be provided to give the adapter additional strength.

Figure 6:
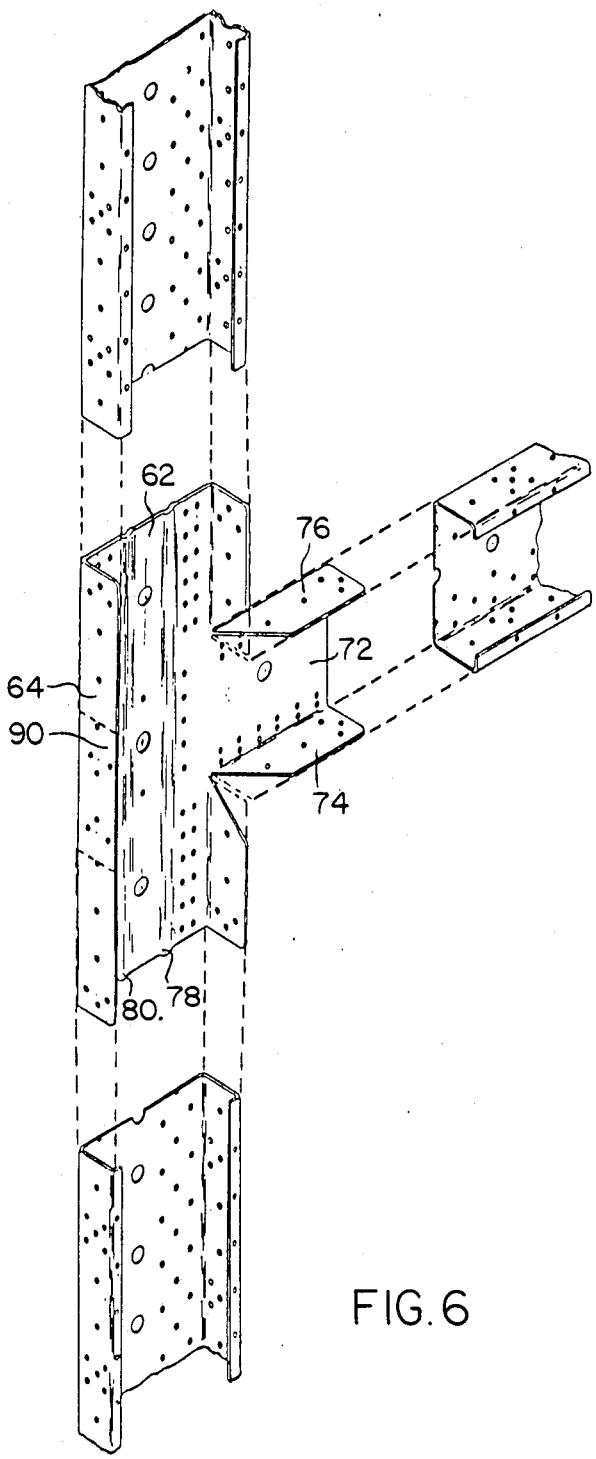
FIG. 6 is an exploded perspective view of a T adapter showing additional framing elements.
Figure 7:
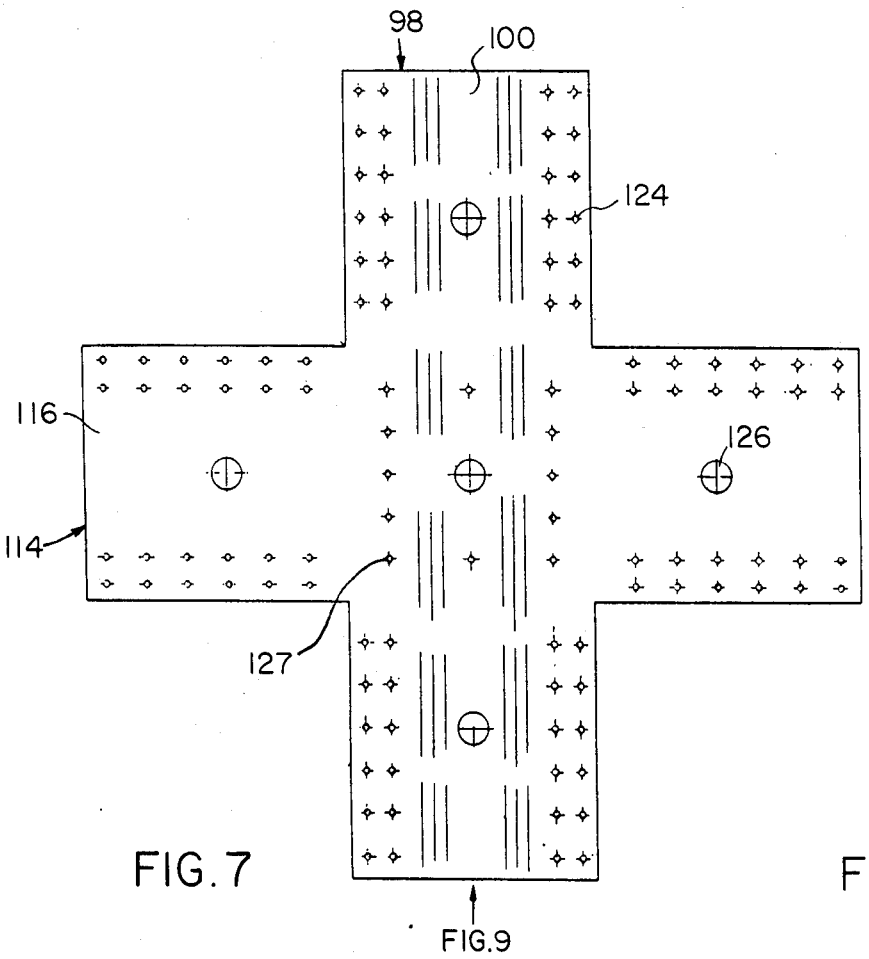
FIG. 7 is a front elevation of a cross adapter according to the present invention.
Figure 8:
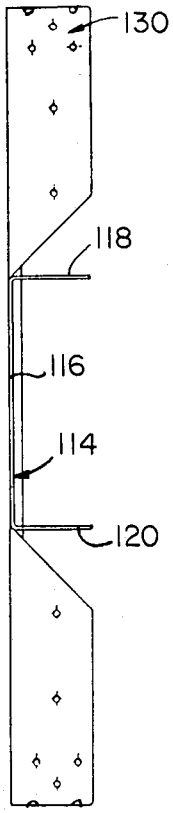
FIG. 8 is a side elevation of a cross adapter according to arrow 8 in FIG. 7.
Figure 9:
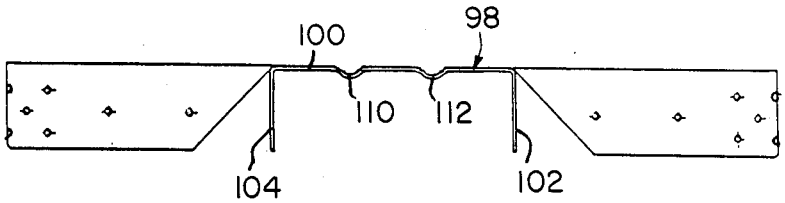
FIG. 9 is a bottom view of a cross adapter according to arrow 9 in FIG. 7.

The girder members nest snugly with the channels 60,70 as indicated by the dashed lines in FIG. 6. A plurality of apertures are precisely positioned in the adapter to align with apertures in the girder members to receive fastening structure and secure the girder members in place on the adapter. The apertures are preferably provided in the web portions as rows of evenly spaced apertures 86. The apertures 86 are preferably provided in two parallel rows running down the length of the web portion at each lateral side of each channel. Additional apertures 88 may be provided at the intersection of the two channels 60, 70 for the attachment of additional structure such as bracing to the adapter. Large diameter apertures 90 may be provided down the longitudinal center of the web portions of each channel to receive large diameter fastening structure to firmly secure the girder members to the adapter as required. The apertures 90 may also be used as pilot holes in a pilot hole/pilot pin process for accurately punching and shearing the adapter.

A pattern of apertures in the flange portions is designed for maximum versatility in the connections to girder members and to additional building structures. The pattern would preferably include a repeating pattern of apertures forming a five hole pattern designated as a pentad 94 with apertures at the corners of an imaginary square and an aperture at its center. The pentads are preferably separated by longitudnally spaced apertures such as the two apertures 96.

Another adapter embodiment for four-way connections, and particularly connecting floor joists to interior wall studs, is depicted in FIGS. 7–10. The adapter has web portins which cross at substantially right angles and which preferably bisect one another to form four arms of equal length. A first channel 98 preferably has a U-shaped cross section with web portion 100 and upturned flange portions 102, 104. Ridges 110, 112 may be formed in the web portion 100 or elsewhere to provide additional stengthening if desired. A second channel preferably has a U-shaped cross section with web portion 116 and upturned flange portions 118, 120. Web portion apertures are preferably provided as before for the "T" shaped adapter. Two parallel longitudinal rows of apertures 124 are provided at each lateral side of the web portions 100 and 116. Longitudinally spaced large diameter apertures 126 may be provided at the center of each web portion to receive large diameter fastening means. The apertures 126 may also be used as pilot holes in a pilot hole/pilot pin or pilot hole/optical scanner process for accurately punching and shearing the adapter. Additional apertures 127 may be provided at the intersection of the two channel positions for the attachment of additional structure such as bracing. The flange portions preferably include a pattern of apertures 130 which preferably is the same pentad pattern space by a longitudinal row of two apertures described above for the flange portions of the T adapter and depicted in FIG. 4.

Figure 10:
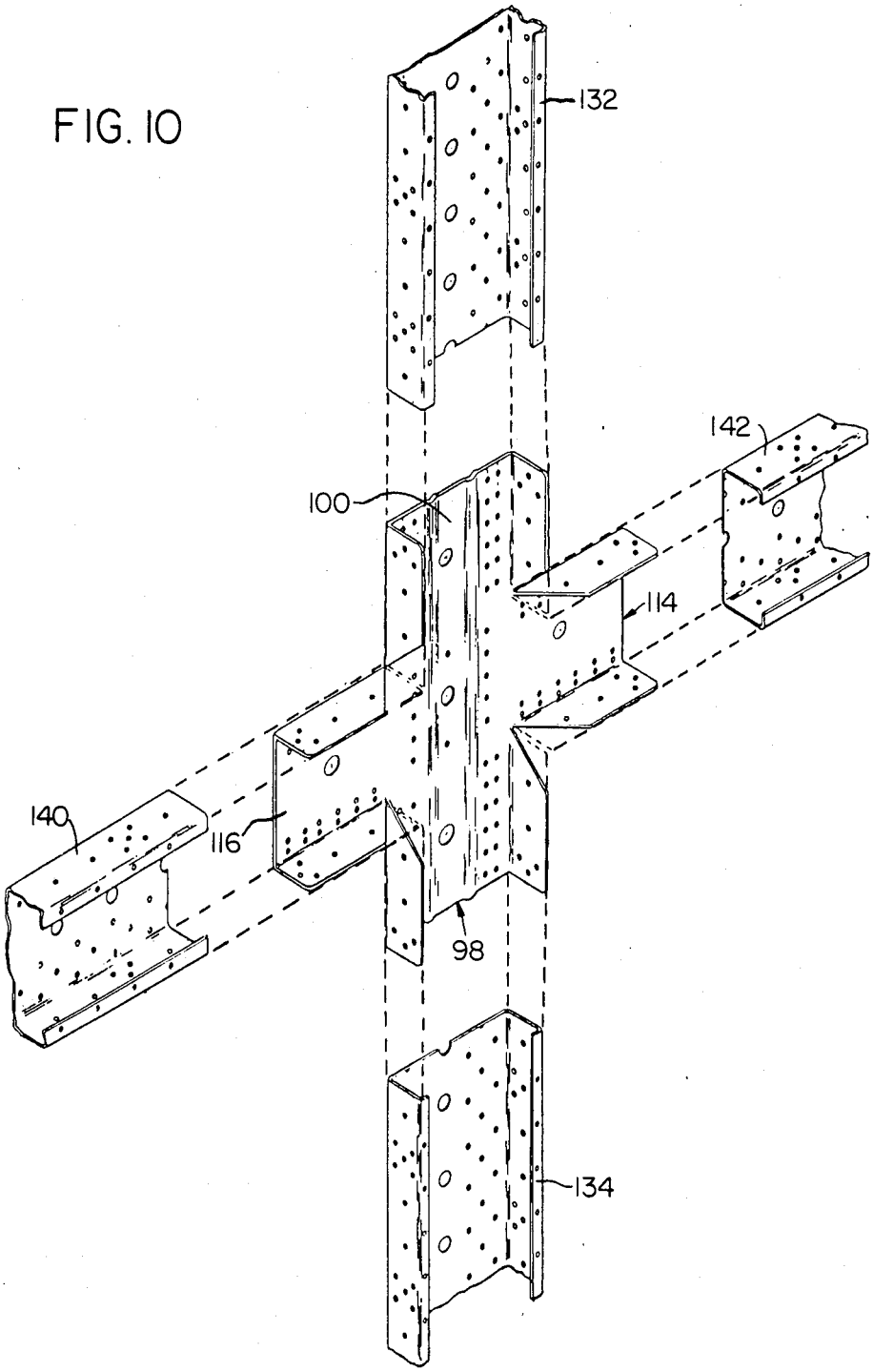
FIG. 10 is an exploded perspective view of a cross adapter showing additional framing elements.
Figure 11:
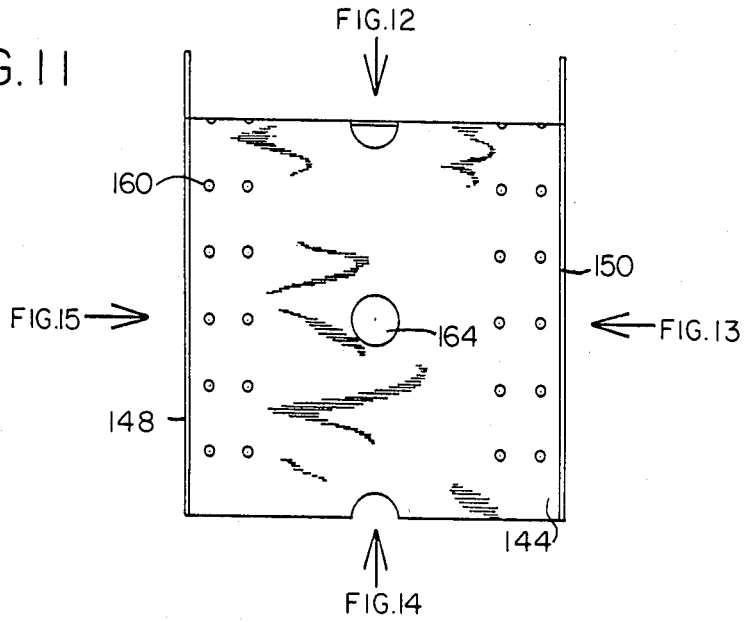
FIG. 11 is a front elevation of an L bracket according to the present invention.
Figure 12:
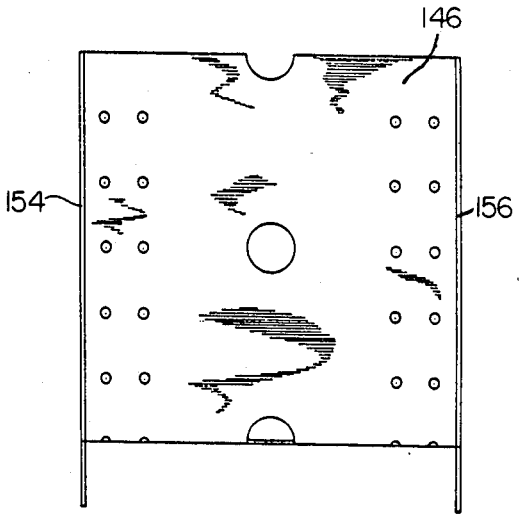
FIG. 12 is a plan view of the bracket according to arrow 12 in FIG. 11.
Figure 13:
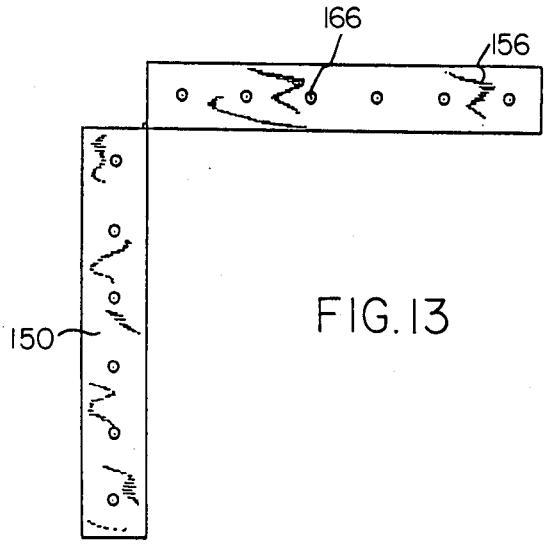
FIG. 13 is a right side elevation of the bracket according to arrow 12 in FIG. 11.
Figure 14:
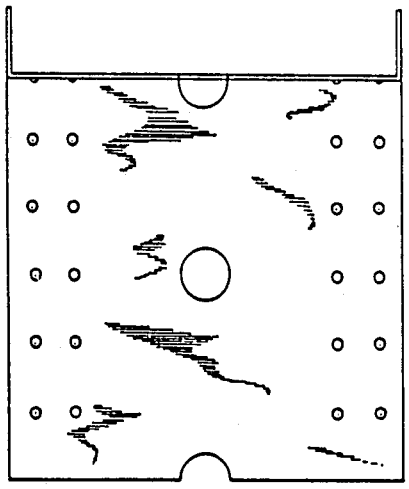
FIG. 14 is a bottom view of the bracket according to arrow 14 in FIG. 11.
Figure 15:
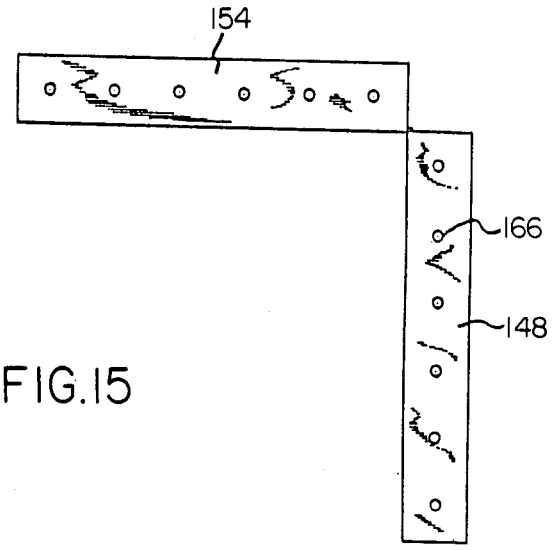
FIG. 15 is a left side elevation of the bracket according to arrow 15 in FIG. 11.
Figure 16:
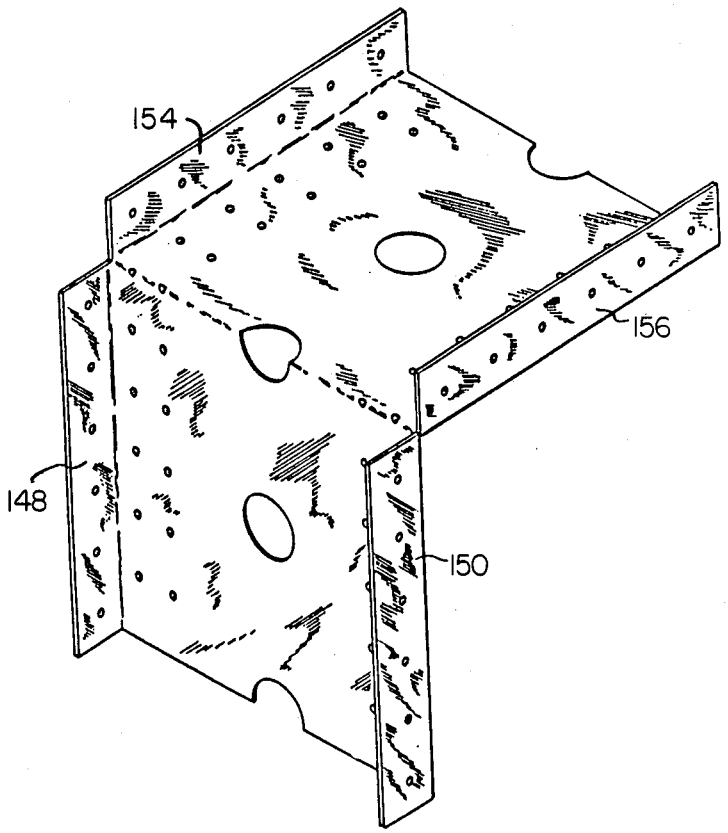
FIG. 16 is a perspective view of the bracket.

The cross adapter is connected to girder members as depicted by the dashed lines in FIG. 10. Interior wall studs 132, 134 are nested snugly with and fastened to the arms of the first channel 98 by suitable fastening means. Floor joists 140, 142 are nested snugly in the second channel 114 and against fastened thereto by suitable fastening means, which preferably are passed through aligned apertures in the girder members and the adapter.

A bracket according to the invention is shown in FIGS. 11–16. The bracket may be used to join ends of structural components to the sides of other components. The bracket includes two substantially perpendicular web portions 144, 146 joined at an edge 157. The web portion 144 has upturned flange portions 148, 150 to form a channel of U-shaped cross sections. The web portions 144, 146 preferably include as before dual longitudinally spaced parallel rows of apertures 160 down each lateral side of the web portion. The flange portions are preferably provided with a plurality of apertures, which may be the single longitudinal row of apertures 166 for the reception of large diameter fastening means. The apertures 166 may be used as pilot holes in a pilot hole/pilot pin or pilot hole/optical scanner process for accurately punching and shearing the bracket. The apertures 160, 164 and 166 align with apertures in the girder members and other components to receive suitable fastening means such as screws and the like.

Figure 17:
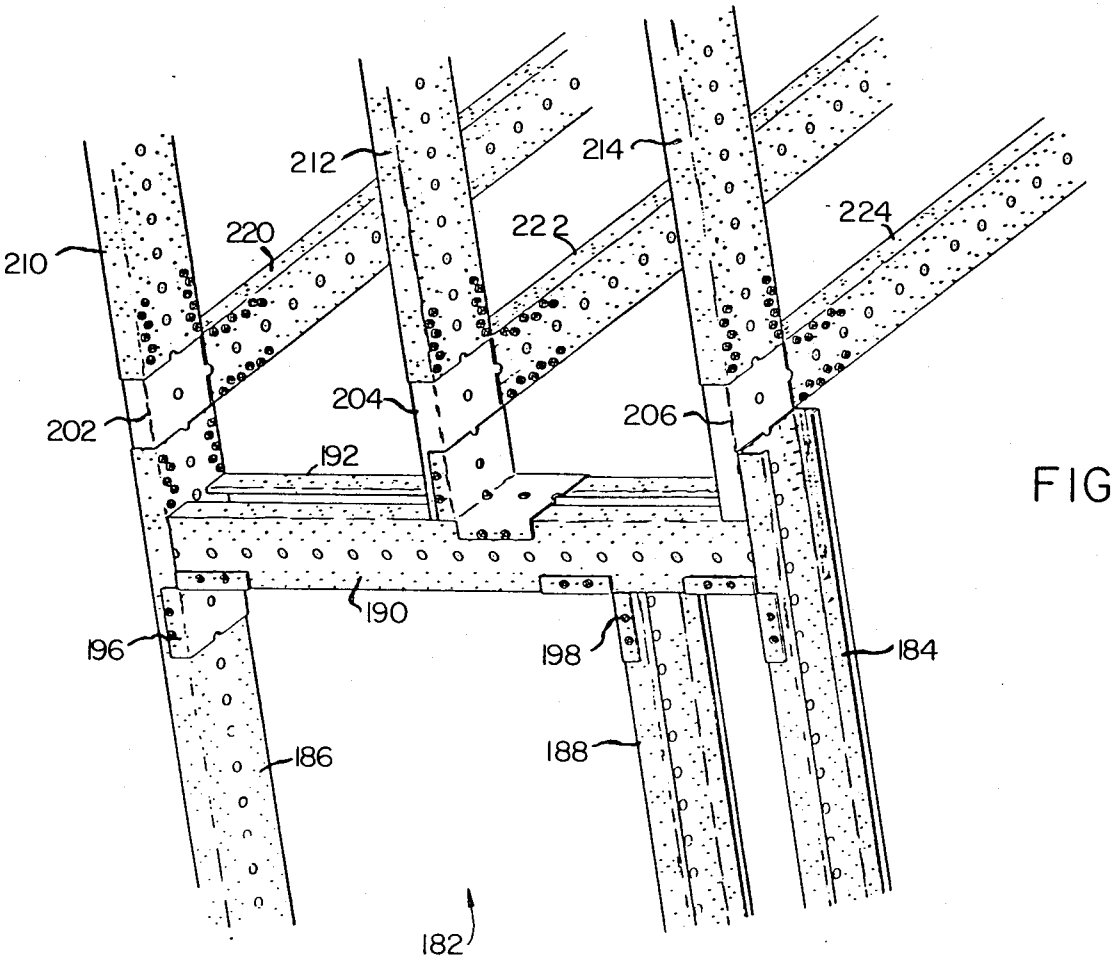
FIG. 17 is a perspective view of the multistory construction according to the invention.
Figure 19:
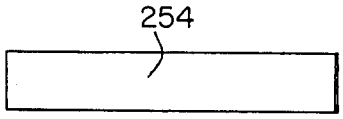
FIG. 19 is a top plan view of the truss adapter according to arrow 19 in FIG. 18.
Figures 18, 20, 22:
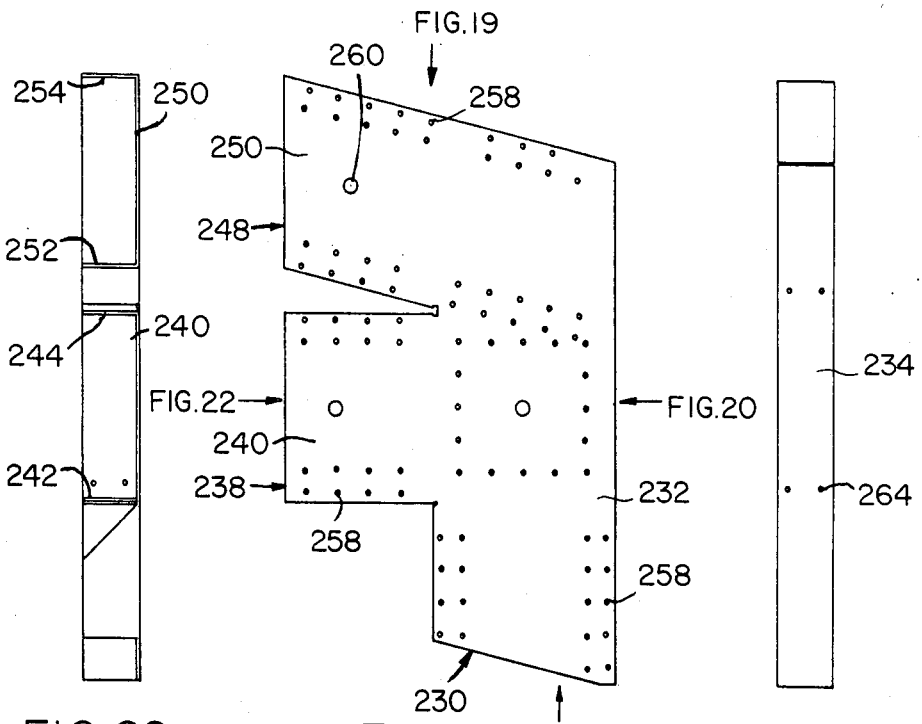
FIG. 18 is a front elevation of the truss adapter according to the present invention.
FIG. 20 is a right side elevation of the truss adapter according to arrow 20 in FIG. 18.
FIG. 22 is a left side elevation of the truss adapter according to arrow 20 in FIG. 18.
Figure 21:
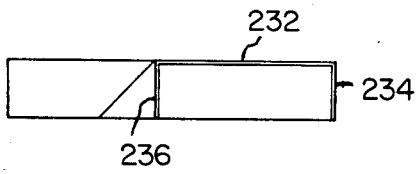
FIG. 21 is a bottom view of the truss adapter according to arrow 21 in FIG. 18.

The manner in which components according to the invention including T adapters, cross adapters and brackets may be interconnected to frame features is shown in FIG. 17. FIG. 17 depicts the top of a door frame 182 which has additional wall studs and floor joists connected to it. The frame is provided between vertical studs 184 and 186. The frame is fashioned from the vertical girder members 186, 188 and horizontal girder members 190, 192 which are provided in parallel tandem fashion for additional strength. Bracket 196 joins the ends of girder members 190, 192 to the side of the vertical girder member 186. Bracket 198 joins the end of vertical girder member 188 to the sides of horizontal girder members 190, 192. The T adapters 202, 204, and 206 are secured to second story vertical studs 210, 212 and 214 respectively. Floor joists 220, 222 and 224 are joined to the short channels of the T adapters 202, 204 and 206 respectively. It is apparent from FIG. 17 that virtually any multistory design can be constructed by the proper placement of components according to the invention.

The dimensions of the apertures and spacing in adapters and brackets according to the invention are included by way of example only and should in no manner be construed as limiting. The longitudinally spaced large diameter apertures at the center of the web portions are preferably of $\frac{3}{4}''$ diameter and are longitudinally spaced approximately 6" from center to center. The small diameter apertures at ach lateral side of the web portions have a diameter of approximately 11/64". These apertures are spaced longitudinally approximately 1" from center to center, and the dual rows of parallel apertures down each lateral side of the web portions are spaced apart approximately $\frac{5}{8}$" from center to center. The web portions are approximately 6" wide. The flange portions are approximately $1\frac{3}{4}$" in length. The apertures in each pentad are of approximately 11/64" in diameter. Each corner aperture is located approximately 1" on a side from its adjacent corner apertures. The longitudinal apertures spacing the pentads are spaced apart and from the center aperture in each pentad approximately 2" from center to center. The pattern of apertures in each channel repeats every 6". The standard hole patterns will remain the same, even though the size of the holes and the spacing between the holes may vary according to the dimensions and proportions of the structural components (e.g. web width, flange size, etc.).

A truss adapter suitable for connecting the headers and joists of roof truss structure to vertical studs is depicted in FIGS. 18–23. The adapter includes a vertical channel 230 formed by web portion 232 and flanges 234, 236. A horizontal header channel 238 is formed by a web portion 240 and flanges 242, 244. An angularly and upwardly directed joist channel 248 is formed by web portion 250 and flanges 252, 254. The web portions preferably include a plurality of apertures including dual longitudinal parallel rows of apertures 258 on each alteral side of the web portions and large diameters longitudinally spaced apertures 260 at the center of the web portions for receiving suitable fastening means. The flanges may be provided with apertures 262 also for the reception of fastening means.

Figure 23:
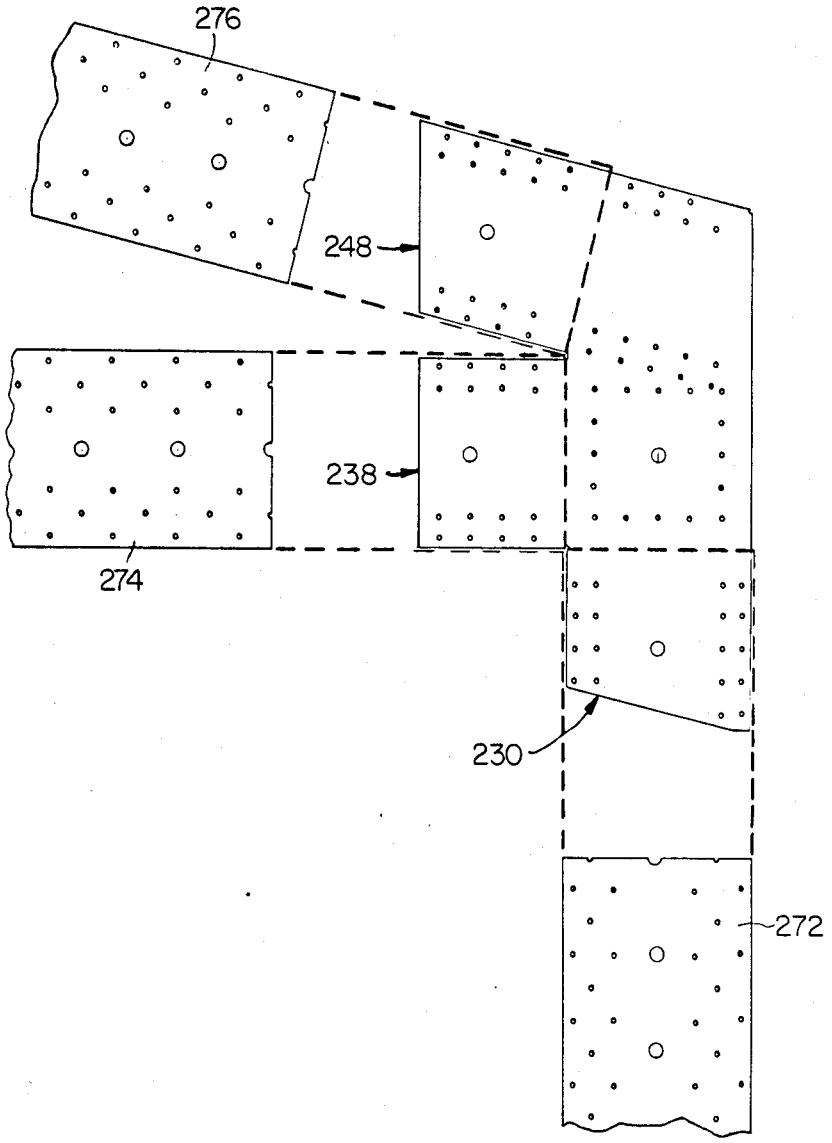
FIG. 23 is an exploded front elevation of the truss adapter showing additional framing elements.
Figure 25:
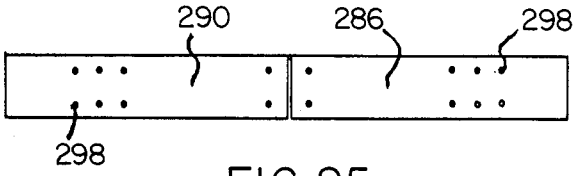
FIG. 25 is a top plan view of the roof ridge adapter according to arrow 25 in FIG. 24.
Figures 24, 26, 28:
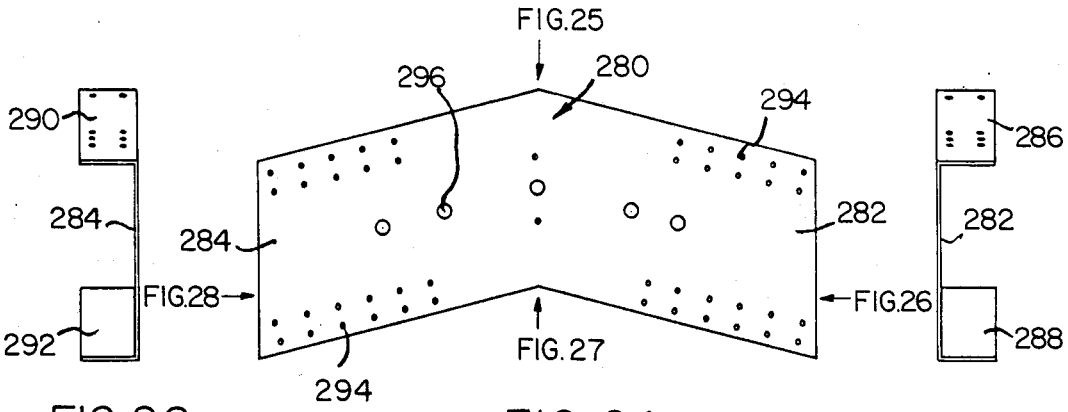
FIG. 24 is a front elevation of the roof ridge adapter according to the invention.
FIG. 26 is a right side elevation of the roof ridge adapter according to arrow 26 in FIG. 24.
FIG. 28 is a left side elevation of the roof ridge adapter according to arrow 28 in FIG. 24.
Figure 27:
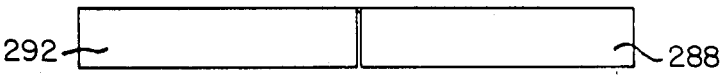
FIG. 27 is a bottom view of the roof ridge adapter according to arrow 27 in FIG. 24.

The manner in which the truss adapter receives girder members to join roof truss members to vertical studs is depicted in FIG. 23. The roof truss adapter 270 is shown receiving the various girder members in a manner depicted by the dashed lines. The vertical stud member 272 is joined to the vertical channel 230 of the truss adapter. Header 274 and joist 276 of the roof truss structure ae similarly connected to the horizontal and upwardly directed channel portions of the truss adapter 238 and 248, respectively. In this manner the roof structure is integrally connected to the vertical studs to provide a tightly interknitted structure whereby stresses are transferred from the roof structure to the vertical studs and thereby to other framing structure.

A roof ridge adapter for angularly joining the members of a roof truss to form a traditionally angled slanted roof is depicted in FIGS. 24–29. The roof ridge adapter 280 includeds two web portions 282 and 284 angularly joined at an edge. The web portion 282 is provided with flanges 286, 288 to form a channel of U-shaped cross-section. Similarly, the web portion 284 is provided with flanges 290, 292 to form a channel of U-shaped cross section. Apertures, including dual longitudinal parallel rows 294 at each lateral side of the web portions and large diameter longitudinally spaced apertures 296 at the center of the web portions, may be provided to receive suitable fastening structure. Additionally, apertures 298 may be provided in the flange portions as parallel longitudinal rows to receive suitable fastening structure.

Figure 29:
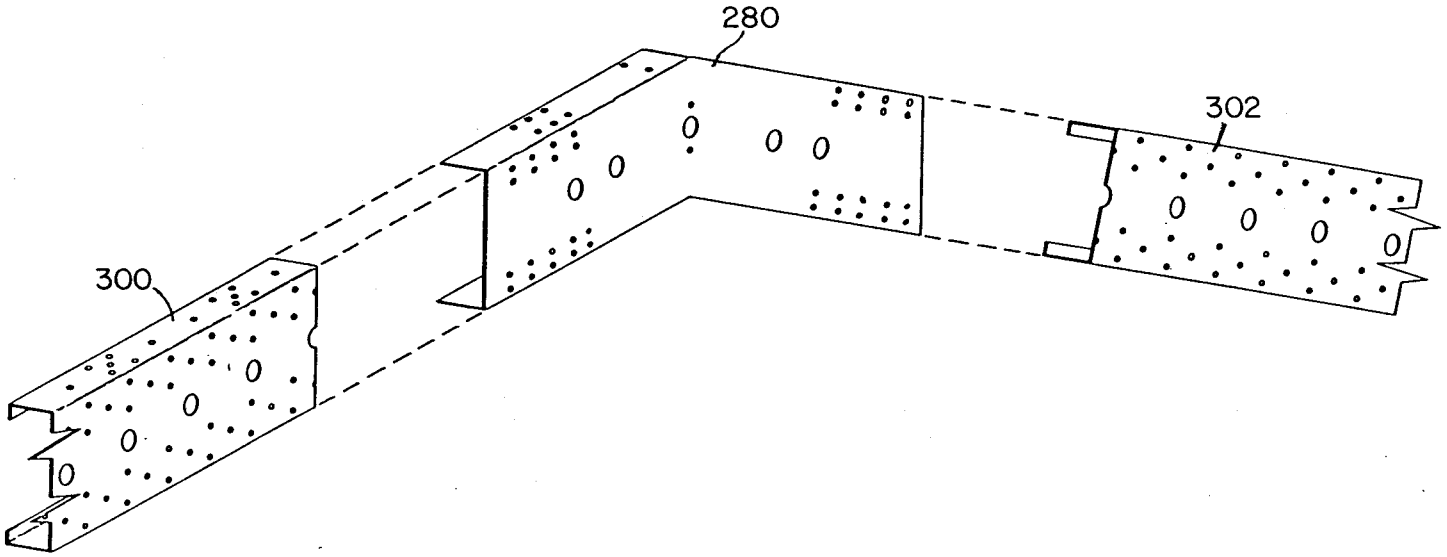
FIG. 29 is an exploded perspective view of the roof ridge adapter with additional framing elements.
Figure 30:
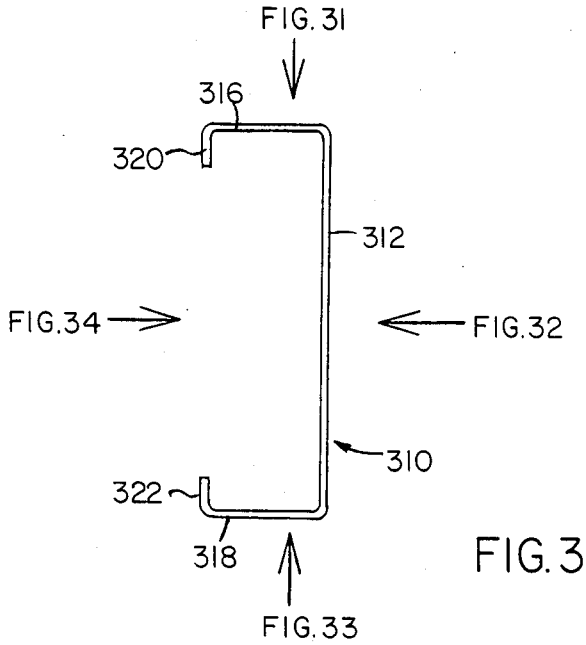
FIG. 30 is a cross-section of the channel member.
Figure 31:
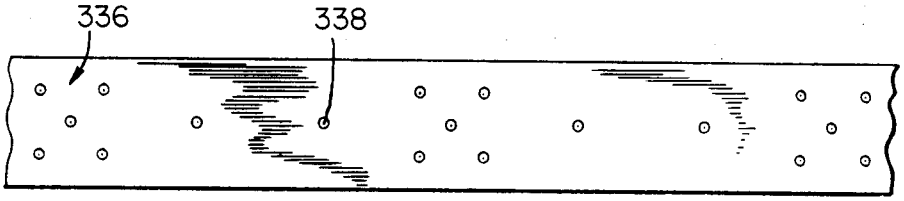
FIG. 31 is a top plan view according to arrow 31 in FIG. 30.
Figure 32:
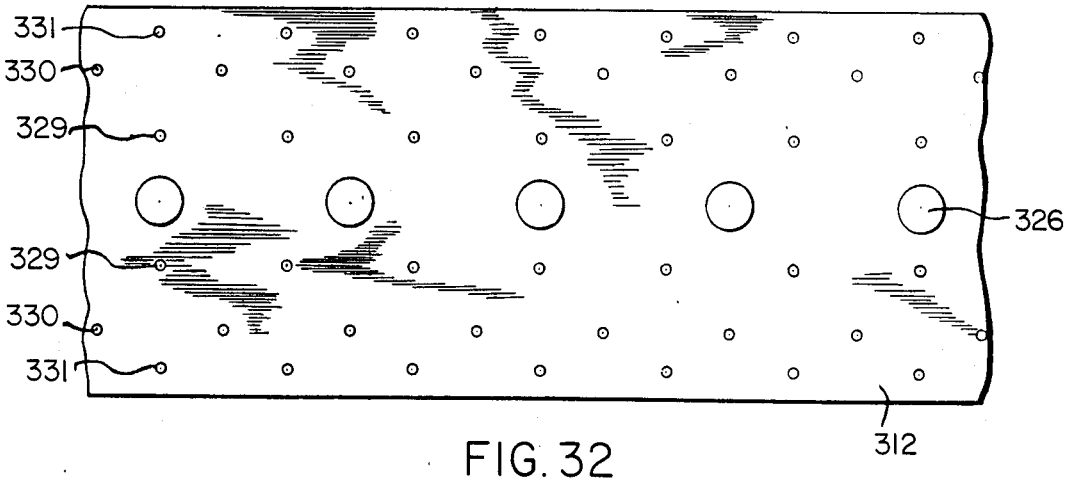
FIG. 32 is a right side elevation according to arro 32 in FIG. 30.
Figure 35:
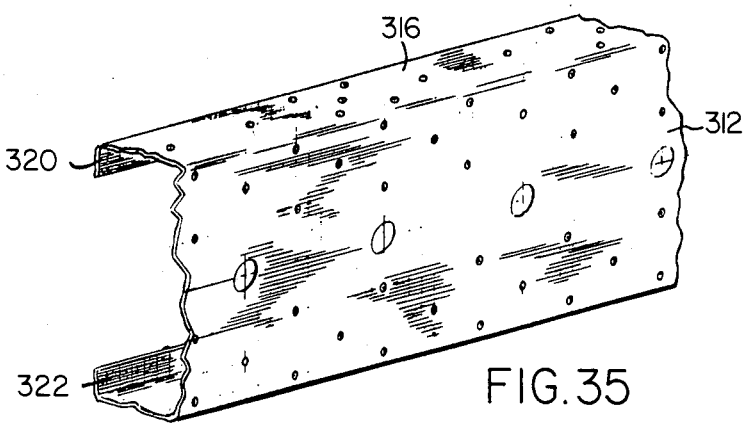
FIG. 35 is a perspective view of the channel member.
Figure 33:
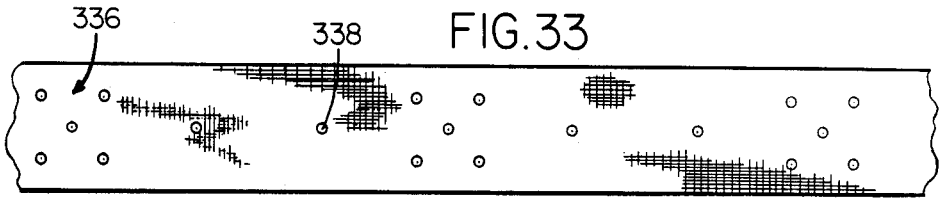
FIG. 33 is a bottom view according to arrow 33 in FIG. 30.
Figure 34:
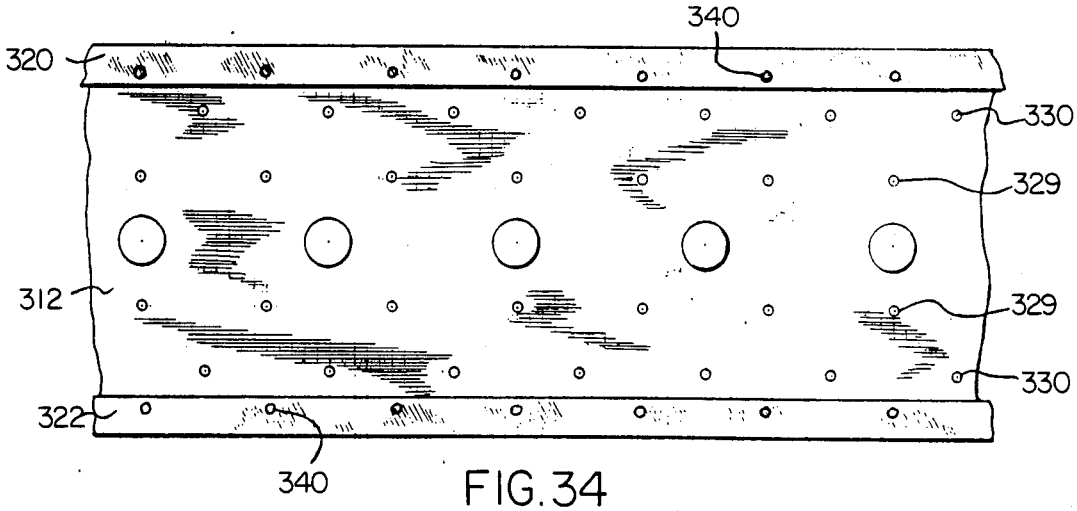
FIG. 34 is a left side elevation according to arrow 34 in FIG. 30.

The roof ridge adapter 280 may be connected to the joists of a roof truss system as shown by the dashed lines in FIG. 29. Roof joist members 300, 302 nest snugly over the channels of the roof ridge adapter 280 where they may be fastened by suitable fastening means passed through aligned apertures in the joists 300 and 302 and the roof ridge adapter 280.

Adaptors and brackets according to the invention may be constructed by several techniques. The adapters are easily formed by stamping processes when formed from metal. It is foreseeable that the adapters could be manufactured from structural plastics by methods suitable for those materials. If made from metal, the preferred materials would include galvanized steel of a thickness between 12 and 20 gauge, and most preferably 14 gauge steel.

Girder members particularly well suited for use in the invention are shown in FIGS. 30–35. Thsi component is described in co-pending U.S. application titled "Structural Component", Ser. No. 797,029, filed herewith on Nov. 12, 1985, the contents of which are herein fully incorporated by reference. The component 310 is a channel member preferably having a substantially squared-off C-shaped cross-section with a web portion 312, two flanges 316, 318 and two inwardly directed lips 320, 322 on the flanges 316, 318, respectively. Longitudinally spaced large diameter apertures 326 are provided at the center of the web portion 312. These apertures can be used in a pilot hole-pilot pin process to provide very accurate shearing of the channel member into proper lengths. The large diameter apertures may also be used to receive large diameter fastening structure. A plurality of small diameter apertures are also provided in the web portion. The small diameter web portion apertures preferably include longitudinal rows of evenly spaced apertures at each lateral side of the longitudinally spaced larger diameter apertures 326. Three rows are preferably provided at each lateral side of the row of larger diameter apertures 326, comprising a lateral innermost rows 329, middle rows 330, and outermost rows 331. The rows of small diameter apertures on each lateral side of the longitudinal row oflarger diameter apertures 326 are preferably symmetric about the longitudinal row of larger diameter apertures 326. The lateral innermost rows 329 and outermost rows 331 of apertures are preferably laterally aligned while the middle rows 330 are longitudinally staggered to provide apertures at the longitudinal midpoint between the apertures of the lateral innermost and outermost rows. The staggered middle rows of small diameter apertures 330 on each lateral side of the web portion 312 provide apertures at every longitudinal half space relative to the longitudinal spacing of the small diameter apertures.

The flanges 316, 318 are provided with a plurality of apertures 336. The flange apertures are preferably provided as a repeating pattern in the longitudinal direction of each flange, the pattern including a pentad 336 with an aperture at each corner of an imaginary square and an aperture at the center of the square. In one embodiment, at least one longitudinal row of apertures 338 preferably includes two apertures. The inwardly directed lip portions 320, 322 are also preferably provided with a plurality of apertures 340.

The provision of apertures in the girder component 310 provides great versatility in the manner in which the components can be interconnected, and particularly to adapters to form multistory structures according to the invention. The dual longitudinal parallel rows of apertures down each lateral side of the web portions of the adapters and brackets are laterally aligned with the longitudinal middle rows 330 and outermost rows 331 of apertures in the web portion of the girder members when the girder members are interfitted with the adapters and brackets with their web portions together. The girder members may be moved longitudinally through the adapter channels and there will be pairs of aligned apertures for the reception of suitable fastening means.

If the orientation of the girder member with the adapters and brackets is reversed such that the lip portions 320, 322 of the girder members rests adjacent the interior of the web portions of the adapters and brackets, the plurality of apertures 340 in the lip portions 320, 322 laterally align with the lateral outermost row of apertures in the adapters and brackets such that longitudinal movement therewith will produced aligned apertures for the reception of suitable fastening means. The various components can therefore be interconnected without the necessity of drilling holes for fastening structure. Construction time is therefore correspondingly reduced and the construction can be performed by relatively unskilled labor.

The unusual strength of the connected parts according to the invention allows the construction of multistory structures without the need to incorporate substantial additional bracing, and also permits use of fewer supporting frame elements for a structure of a given size, as compared to conventional building means. The studs, floor joists, and roof truss elements shown in FIG. 1 are intimately connected to one another across a given width of the building. The studs are attached end wise to the foundation and successively to one another from one story to the next. Therefore, each of the studs supports the usual axial load, and also tends to cooperatively bear loads transmitted from the other elements. Similarly, the floor joists support the usual tension load and also bear and transmit loads supplied to the remaining elements. The full connections between the adapter elements and the frame elements fix the frame elements both in position and in relative orientation. The connections accordingly define a structure in which virtually all the frame components are involved in supporting all parts of the load. This applies not only to supporting the dead weights of building materials, but also to variable loads such as wind, and vibrational or noise-causing forces of various descriptions.

Figure 36:
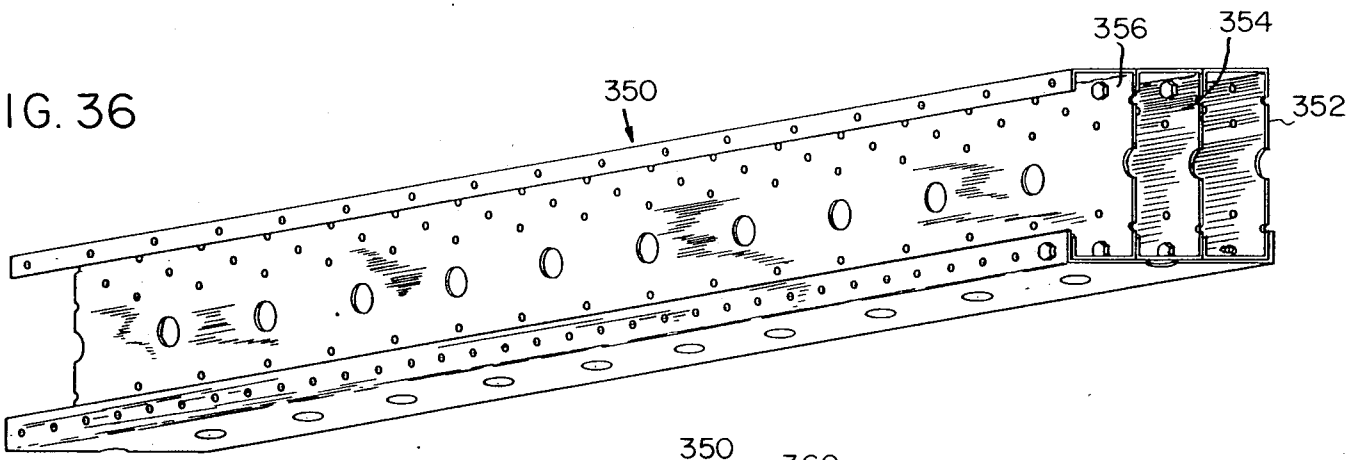
FIG. 36 is a perspective view of the compound component.
Figure 37:
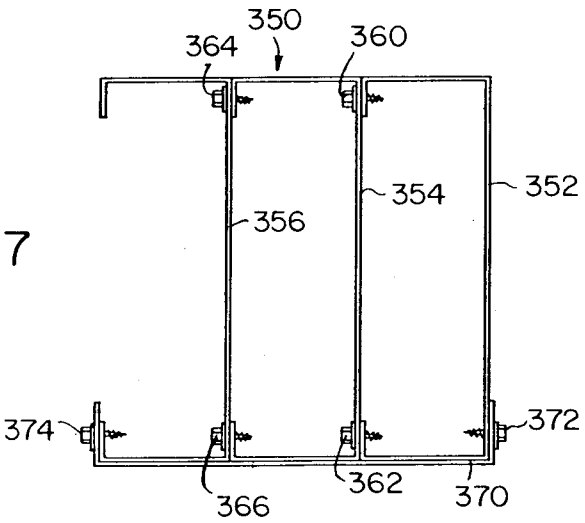
FIG. 37 is an end view of the compound component of FIG. 35.

The multistory construction system of the invention can be universally applied to any incremental size desired. It is believed that the metallic studded construction consisting of single girder members is perfectly adequate for supporting a load of traditional single-family dwellings and also multiple story buildings up to 3 or 4 stories. Extremely large structures may at some point require the inclusion of additional members to support the additional weight. In such cases compound components can be provided. FIGS. 36–37 show a compound component 350 in which 3 girder members 352, 354, 356 according to the invention are fastened substantially front to back. The inwardly directed lips of the girder member 352 are fastened by suitable means such as screws 360, 326 to the back of the web portion of the girder member 354. The inwardly directed lips of the girder member 354 are similarly fastened to the back of the web portion of the girder member 356 by screws 364, 366. It will be appreciated that any number of girder members may be connected in this fashion to produce compound structural elements of great strength. In this manner, very large multistory constructions with very large loads can be constructed accoding to the invention and with very relatively few structural members. An upwardly-opening channel member 370 of U-shaped cross-section may be included to firmly hold the compound component together. The channel membr 370 may be joined to the component by fastening screws 372 to the web portion of the girder member 352, and screws 374 to the inwardly directed flange of the girder member 356.

Another compound component according to the invention is depicted in FIGS. 38–39. In this embodiment, the compount component 380 is produced by the interconnection of four girder members 382, 384, 386, and 388 according to the invention. The girder members 382, 384 are in parallel spaced relation to one another with their inwardly directed lips directly opposite. Corners formed by the inwardly directed lips and flange portions of the girder members 386 and 388 nest snugly inside the corners formed by the web portions and flange portions of the opposing girder members 382, 384. The position of apertures in the girder members as described above is such that apertures in the flange portions align with apertures in the web portions to receive suitable fastening structure such as screw 390–393. In this manner a very closely interknit compound component is produced with great strength.

The girder members according to the invention are preferably formed of metal or other strong and durable materials. Metal girder members may be formed by conventional metal forming techniques. Roll forming techniques may be used to mass produce the girder members in a time and cost efficient manner. The whole pattern would typically be punched from a single sheet of material prior to rollforming. Rollformers suitable for construction of girder members according to the invention are known in the art and would include the Contour rollformer "Standard Duty 6000". When produced from metal, galvanized steel is a preferable metal. The metal would preferably be 16–20 gauge and most preferably 20 gauge. Other materials for construction of the girder members are foreseeable, and would include structural plastics with good strength and durability characteristics.

Figure 40:
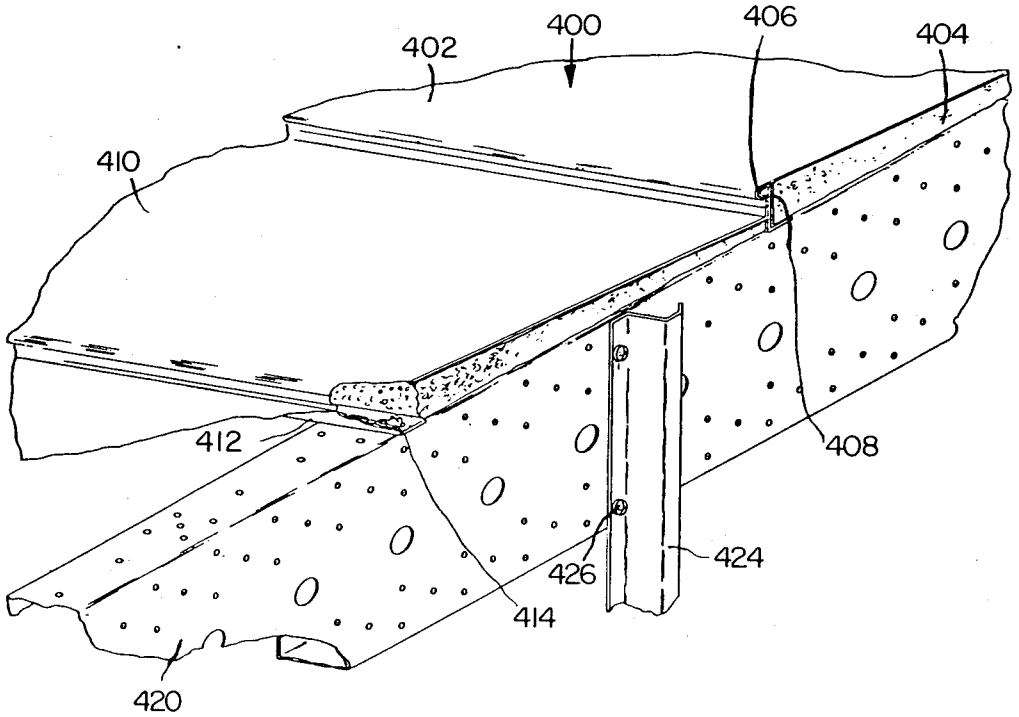
FIG. 40 is a perspective view of roofing or siding attached to a component according to the invention.

A framework according to the invention may be rapidly taken from the framing stage to completion due to the ready availability of numerous apertures in precision layouts on the many girder members according to the invention. Exterior panelling may be quickly attached to the exterior framing by means depicted in FIG. 40. In this figure there is shown an exterior panel 400 having an exterior shell 402 of substantially triangular cross-section. Insulation 404 may be provided within this shell. The bottom lip of the exterior shell 402 of each panel forms a groove 406. The groove 406 snugly fits a tongue 408 formed in the top of the next succeeding panel 410 to firmly interlock the panels. Fastening plate 412 is provided at the bottom of each panel to receive screws 414 to fasten the panel to the stud 420. In this manner, successive exterior panels may be rapidly installed by the respective tongue and groove portions and secured in place by screws. The exterior panels are pre-engineered such that apertures in the fastening plates 412 align with apertures in the studs 420 whereby no drilling is necessary to secure the panels in place. Additional bracing such as the Z-brace 424 may also be rapidly attached to the girder members by the simply alignment of apertures and insertion of suitable fastening structure such as screws 426.

Figure 41:
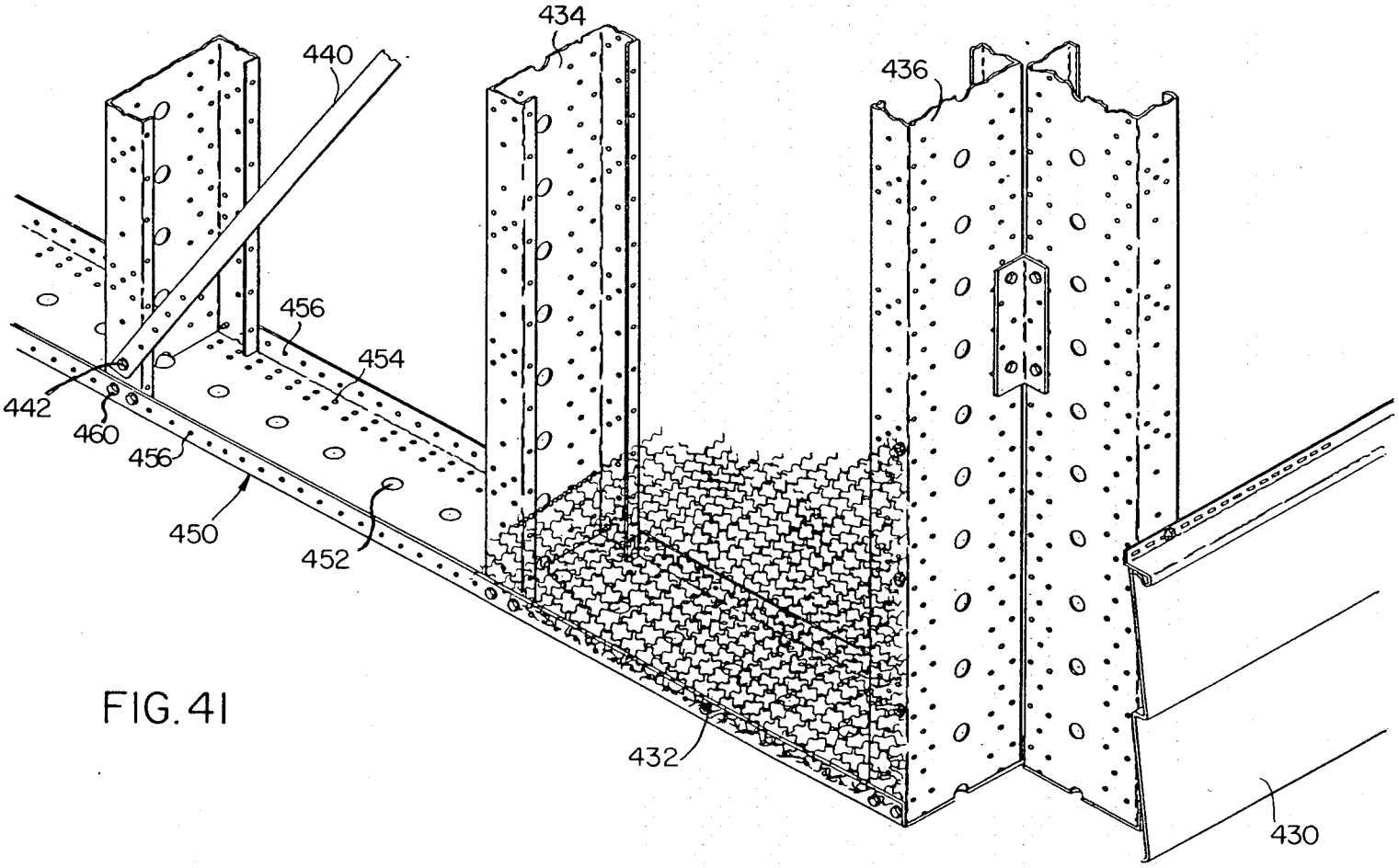
FIG. 41 is a perspective view of exterior covering attached to framing according to the invention.

FIG. 41 depicts a section of a building frame which combines exterior panelling 430 according to the invention on one exterior wall and yet may similarly allow conventional exterior to be rapidly formed on an adjacent wall. Metal lathe 432 is rapidly secured to the flange portions of the studs 434, 436 by suitable structure such as screws. Stucco may be applied dover the metallathe according to conventional techniques. Strapping 440 may also be rapidly attached to the studs by suitable structure such as screws 442.

Conventional building techniques suggest the necessity of a footing. The construction system of the invention is rapidly and easily connected to conventional footings. FIG. 41 shows a track 450 which preferably is a channel member having a substantially U-shaped cross-section with a web portion and two side portions. A pattern of apertures may be provided in the track 450 identical to that described for the adapter members, that is, with large diameter apertures 452 longitudinally spaced down the center of the web portion, dual rows of small diameter apertures 454 spaced longitudinally down each lateral side of the web portion, and a plurality of longitudinally spaced apertures 456 down each flange portion. The track 450 may be secured to the footing by suitable fastening means including lag bolts. Apertures in the side portions of the studs are easily aligned with the apertures 456 in the flange portions of the track 450 to permit passage of suitable fastening structure such as screws 460. In this manner the studs according to the invention may be quickly tied to the track, whereupon additional building structure may be quickly assembled to the studs toward rapid completion of the structure.

Figure 42:
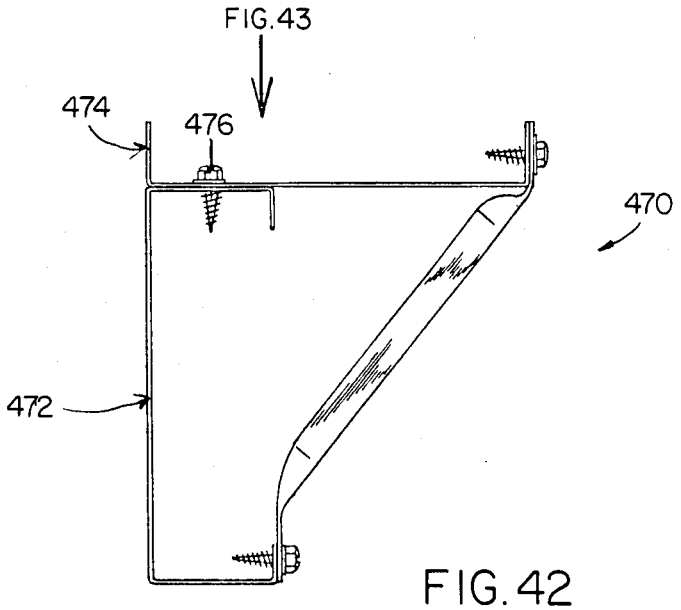
FIG. 42 is an end view of the footing frame apparatus.
Figure 43:
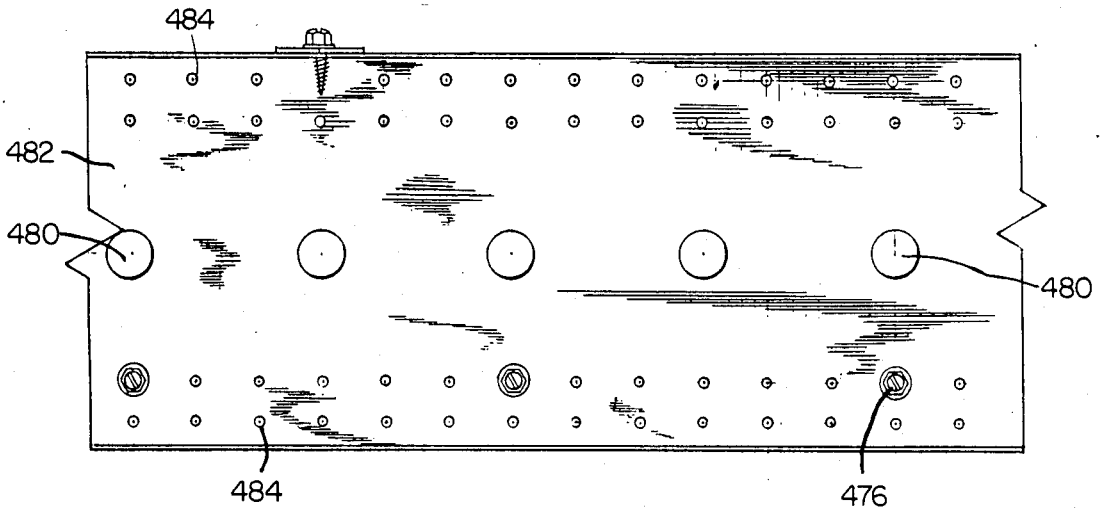
FIG. 43 is a top plan view according to arrow 43 in FIG. 42.
Figure 44:
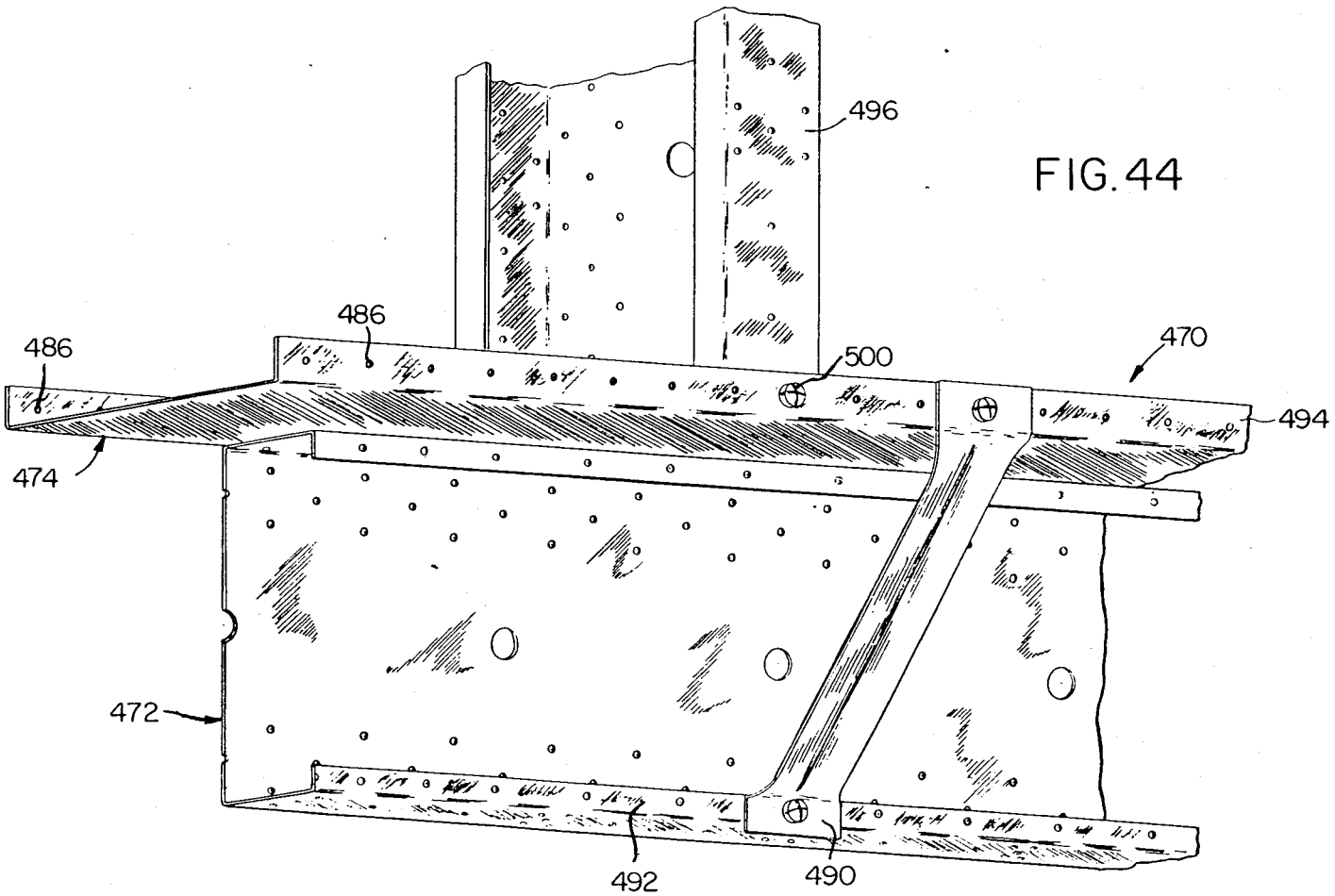
FIG. 44 is a perspective view of the footing frame apparatus attached to additional framing elements.
Figure 49:
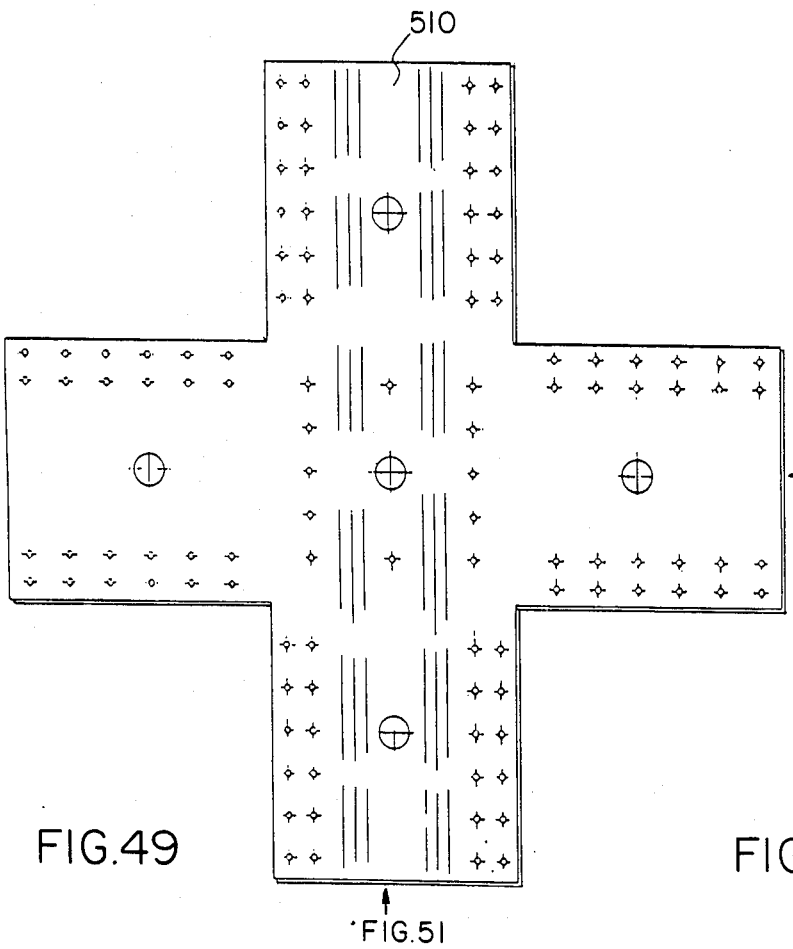
FIG. 49 is a front elevation of the closed channel cross adapter according to the invention.
Figure 50:
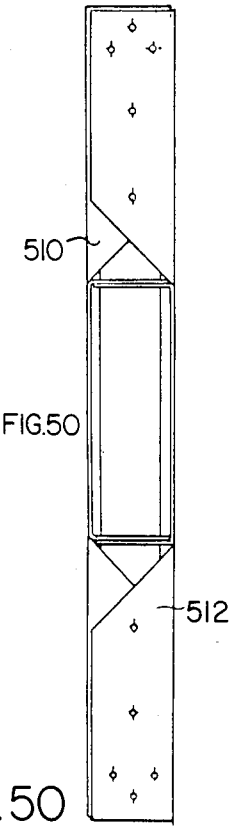
FIG. 50 is a right side elevation according to arrow 50 in FIG. 49.
Figure 51:
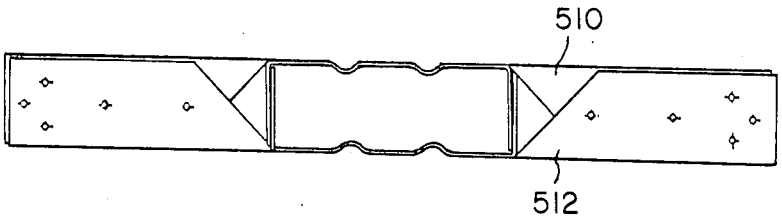
FIG. 51 is a bottom plan view according to arrow 51 in FIG. 49.
Figure 53:
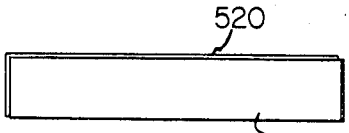
FIG. 53 is a top plan view according to arrow 53 in FIG. 52.
Figure 56:
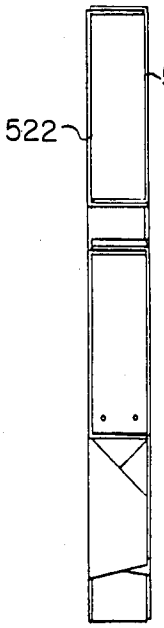
FIG. 56 is a left side elevation according to arrow 56 in FIG. 52.
Figure 52:
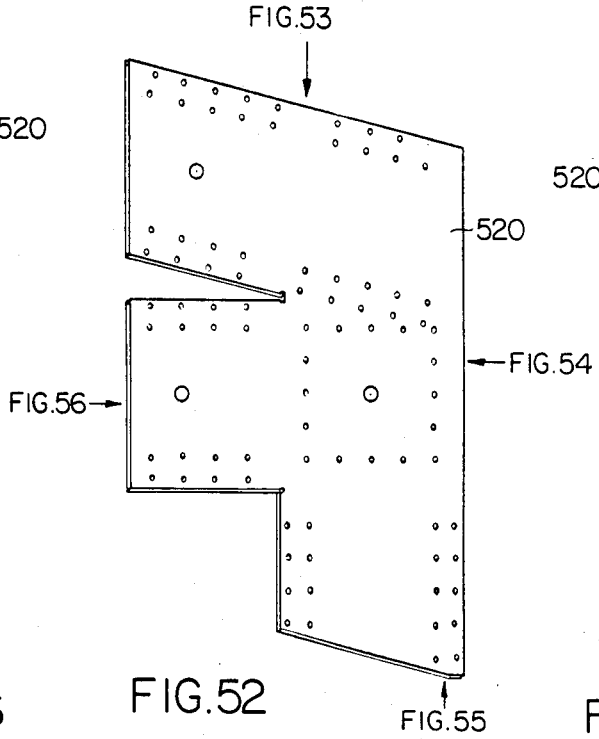
FIG. 52 is a front elevation of the closed channel truss adapter according to the invention.
Figure 54:
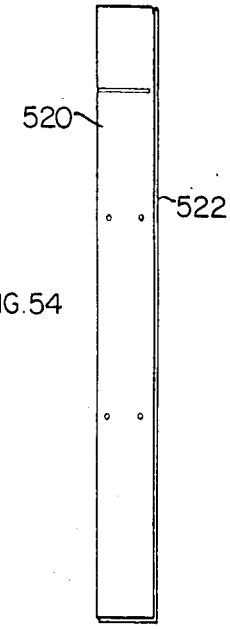
FIG. 54 is a right side elevation according to arrow 54 in FIG. 52.
Figure 55:
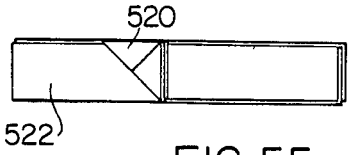
FIG. 55 is a bottom view according to arrow 55 in FIG. 52.
Figure 58:
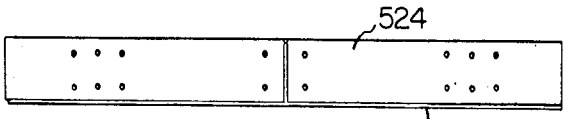
FIG. 58 is a top plan view according to arrow 58 in FIG. 57.
Figures 57, 59, 61:
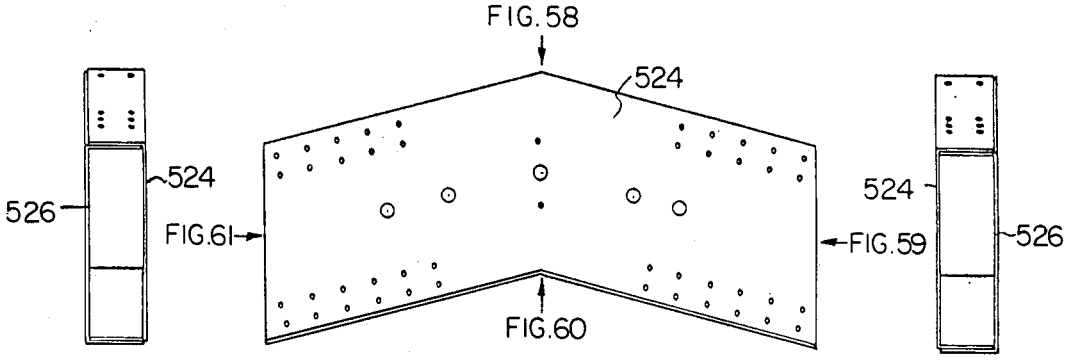
FIG. 57 is a front elevation of the closed roof ridge adapter according to the invention.
FIG. 59 is a right side elevation according to arrow 59 in FIG. 57.
FIG. 61 is a left side elevation according to arrow 61 in FIG. 57.
Figure 60:
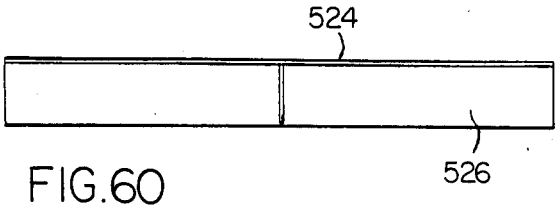
FIG. 60 is a bottom view according to arrow 60 in FIG. 57.
Figure 62:
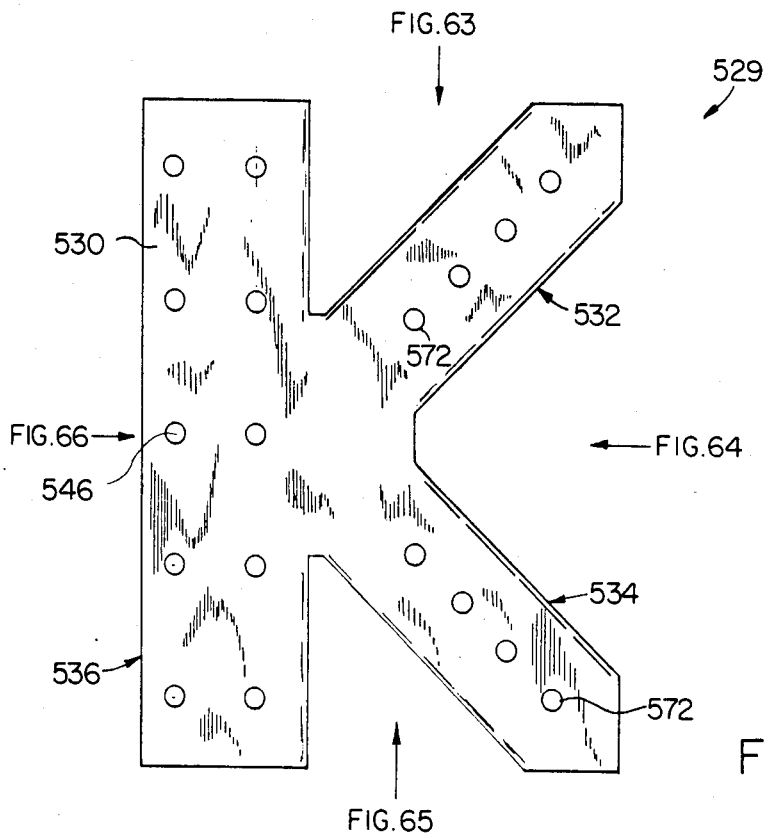
FIG. 62 is a front elevation of the bar joist adapter according to the invention.
Figure 63:
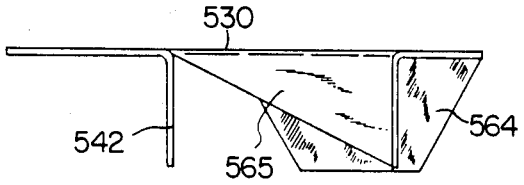
FIG. 63 is a top plan view according to arrow 63 in FIG. 62.
Figure 64:
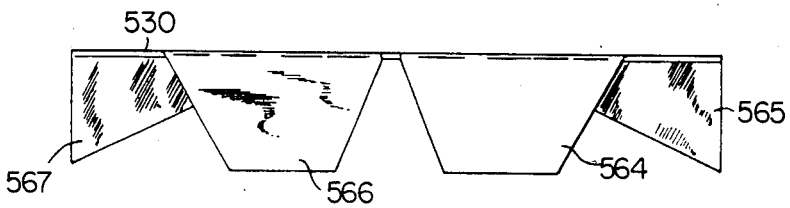
FIG. 64 is a right side elevation according to arrow 64 in FIG. 62.

It may be desirable in some instances to substantially construct a structure before the footing is poured. This technique is set forth fully in co-pending U.S. application titled "Method and Apparatus for Constructing Building Structures", Ser. No. 796,915 filed herewith on Nov. 12, 1985. This application discloses a method and apparatus for constructing building structures and the like in which a footing frame is erected in the design and dimensions of the desired footing. The footing frame is preferably levelled by suitable levelling means. Further building structure is attached to the footing frame. The footing is then constructed by using the framing effect of the footing frame after attachment to the building structure. A footing frame apparatus according to the invention is shown in FIGS. 42–44. The footing frame 470 includes form structure 472 which preferably is identical to the girder members discussed above. Track means preferably comprises a channel member 474 of substantially U-shaped cross-section and secured to a side portion of the channel member 472 by suitable fastening means such as screws 476. The track member 474 is preferably identical to the track member 450 discussed above for conventional footings and depicted FIG. 41. The track member 474 accordingly would have large diameter apertures 480 spaced longitudinally down the center of the web portion 482, dual rows of smaller diameter longitudinally spaced apertures 484 down each lateral side of the web portion 482, and a plurality of apertures 486 down each flange portion of the track member 474. Bracing structure 490 may additionally be provided, preferably in the form of V-brace members affixed to an inwardly directed lip 492 of the form member 472 and to a flange portion 494 of the track member 474.

The footing frame 470 is constructed in the desired footing design and then preferably levelled. Additional building structure may then be attached to the track member 474 such as the stud 496 shown n FIG. 44. The studs are rapidly attached to the track member by the simple process of aligning apertures in the flange portions of the studs with apertures in the flange portions of the track member, and the attachment of suitable fastening structures such as screw 500. The footing may then be poured according to conventional practices. The footing frame 470 becomes anchored in the footing material to secure the structure in place. In this manner, substantial building construction can occur without the necessity for waiting for the footing to cure. Also, precise alignment and assembly of the various components is possible without a skewing effect which can be created by improper settling of the footing.

The particular fastening means for interconnecting channel members, adapters, siding, roofing and other portions of the structure can be of any convenient type. Screws, rivets or nut-and-bolt arrangements are possible. It is presently preferred that hex-head sheet metal screws be employed for most of the connections which type can be conveniently driven using electric drills having nut driver screw-engagement chucks. The connection holes are already provided at the incremental spacings in each of the interfitting members, and moreover, the connection holes align precisely at each of the increments. Therefore, no other holes need be provided and the user need only affix the connection members to pre-formed, pre-aligned holes in order to complete assembly.

Figure 65:
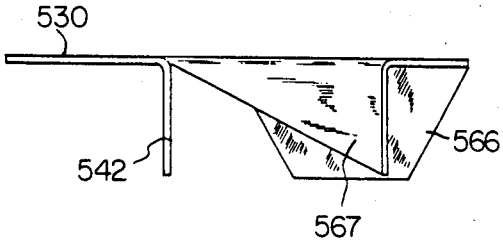
FIG. 65 is a bottom view according to arrow 65 in FIG. 62.
Figure 66:
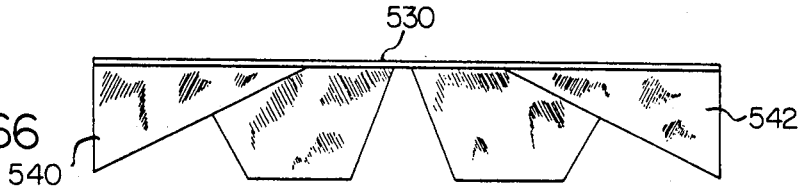
FIG. 66 is a left side elevation according to arrow 66 in FIG. 62.
Figure 67:
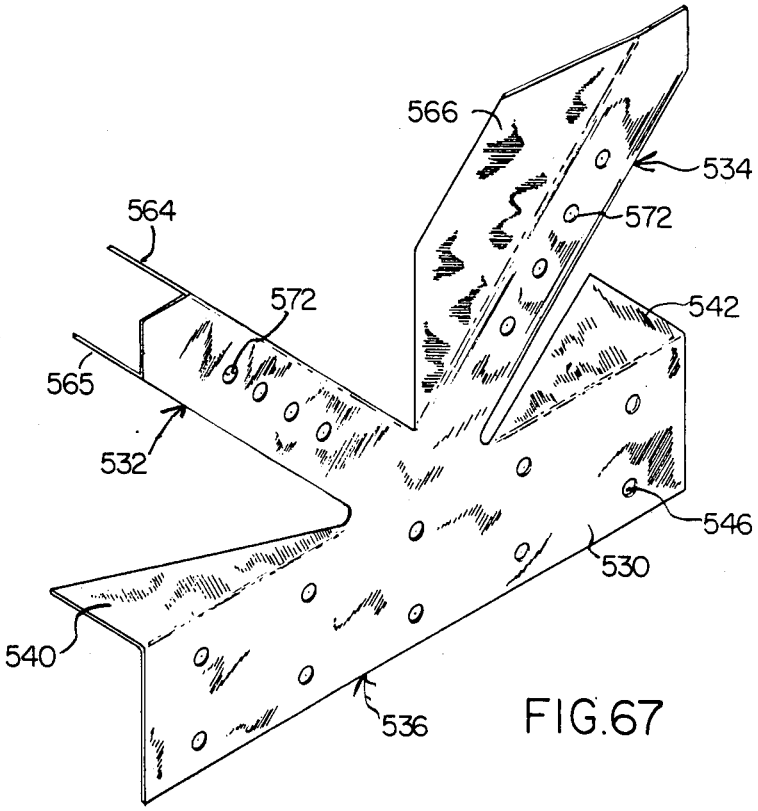
FIG. 67 is a perspective view of the bar joist adapter according to the invention.
Figure 68:
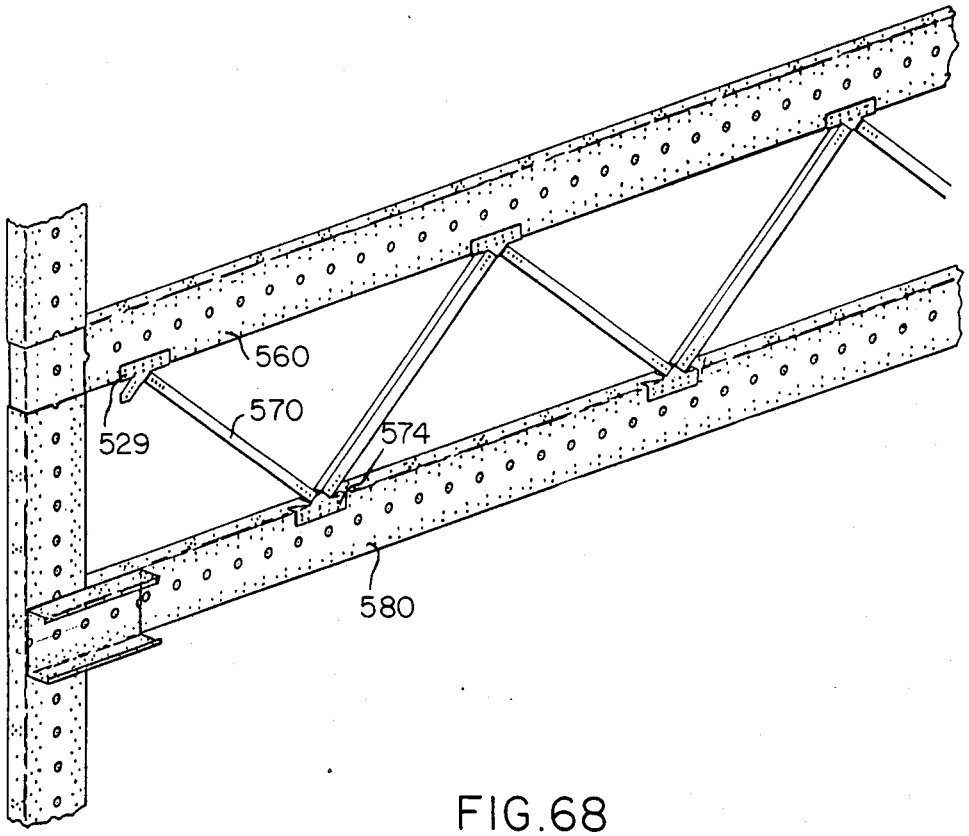
FIG. 68 is a perspective view of bar joist adapters enabling connection between girder members.

Multistory structures according to the invention show high integrity without the need for substantial additional bracing. If such bracing is necessary for extreme loads, additional structure can be provided. A bar joist adapter is shown in FIGS. 65–67. The bar joist adapter 529 includes a substantially K-shaped web portion 530, with two angularly extending arms 532 and 534, which extend from a girder connecting portion 536. The girder conecting portion 536 includes flanges 540, 542 to form a substantially L-shaped cross-section which fits over the corner of a girder member, as the girder member 560 in FIG. 68. The bar joist adapter is secured by alignment of apertures 546 in the web of the girder connecting portin 536 with apertures in the girder member 560 and the attachment of suitable fastening means. The angularly extending arms 532, 534 include flanges 564–565 and 566–567, respectively. the flanges and the webs of the angularly extending arms form U-shaped cross-sections for the attachment of suitable angle or channel structure, as the angle iron 570 in FIG. 68. The angle or channel structure is attached through apertures 572 in the web portion of each angularly extending arm. In this manner, the girder member 560 is connected through the bar joist adapter 529 and the angle iron structure 570 to a bar joist adapter 574, and thus to girder 580 for additional support (FIG. 68). Additional coupling may be provided by additional bar joist adapters and angle or channel structure as shown in FIG. 68.

Even if stretched to the design limitations of structural size, the system of the present invention is highly superior to traditional building elements in both strength and ease of manufacture and use. The various elements of the invention can be formed from relatively lightweight galvanized steel or aluminum of about 20 gauge, extruded or easily bent from sheets of the metal.

The parts may therefore be produced at a relatively low cost, which cost saving is made even more remarkable by the saving in labor costs during construction and the extreme durability of the resulting structure. Moreover, a review of the foregoing specification will show that virtually all components and connections can be formed from relatively few members. The girder member may be used alone as a stud, joist, or roof truss member or in compound components, in a footing frame, and in other structure. The track member may be used as a stud track in conventional footing systems, in the footing frame 470 discussed above, in compound components such as the component shown in. FIGS. 35–38, and in other structure. The precise provision of apertures in these components allows accurate interconnection and the assembly of virtually an entire multistory structure with little custom fitting required to correct for design tolerances. The adapters of the invention quickly and precisely interconnect girder members to the rapid completion of a multistory construction. Reduced costs in construction time and requirements for skilled labor are realized.

The device of the invention is capable of a number of modifications without departing from the spirit thereof. Reference should be made to the appended claims rather than the foregoing specification as indicating the true scope of the invention.

I claim:

1. An improved system for constructing load-bearing structures for multistory buildings and the like on a foundation, with prefabricated sets of interconnectable girder members, connecting plate members and attachment means for selectively securing the girder and plate members to one another, the improvement comprising:

the girder members being prefabricated in a plurality of incrementally different lengths and having flanges with a web portion therebetween forming channel-shaped cross-sections of uniform web width, at least some of the girder members being vertically-oriented;

each of the plate members being formed with flanges to form receiving channels of uniform web width and cross-section, the respective web widths at each end of each girder member and each receiving channel being dimensioned to enable portions of each to nest snugly one inside the other, the receiving channels being directed to bear and transmit primary loads between the girder members of successive building stories, the primary loads being borne by and transmitted between the girder and plate members in planes defined by the nested webs, the flanges of the nested ends bearing against one another to provide high rotational rigidity and overall frame stiffness;

the attachment means being engageable with nested portions of both the girder and plate members to provide full surface engagement of the nested web portions, whereby a plurality of structures for buildings, of varied size and shape, may be easily constructed from sets of prefabricated girder members and prefabricated connecting plate members secured together by the attachment means; and means for securing at least some of the vertically-oriented girder members to the foundation.

2. The system of claim 1, wherein the plate members comprise two receiving channels intersecting at right angles.

3. The system of claim 2, wherein the receiving channels substantially bisect one another to form a cross shape.

4. The system of claim 2, wherein one receiving channel extends perpendicularly in one direction from the other receiving channel to form a T shape.

5. The system of claim 1, wherein the attachment members are screws with self-tapping threads.

6. The system of claim 5, wherein the apertures are formed in patterns of rows of holes.

7. The system of claim 6, wherein the rows of holes are parallel to one another and centers of the holes of each row are in lateral alignment with centers of the holes of each other row.

8. The system of claim 1, wherein the apertures are formed in identical patterns on both of the girder members and the receiving channels.

9. The system of claim 1,wherein the girder members are provided with apertures throughout their length, enabling at least two of the girder members to be secured laterally to one another for enhancing load capacity.

10. Th system of claim 1, wherein two plate members are joined in facing interknitted alignment, with respective flange portions on one plate member interknitted in adjacent alignment with complementary flange portions on the other plate member, to form closed receiving channels of box-shaped cross-section.

* * * * *